US006652066B2

(12) United States Patent
Teshigawara et al.

(10) Patent No.: US 6,652,066 B2
(45) Date of Patent: Nov. 25, 2003

(54) INK JET PRINTING APPARATUS AND INK JET PRINTING METHOD

(75) Inventors: Minoru Teshigawara, Kanagawa (JP); Naoji Otsuka, Kanagawa (JP); Kiichiro Takahashi, Kanagawa (JP); Hitoshi Nishikori, Tokyo (JP); Toshiyuki Chikuma, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/984,353

(22) Filed: Oct. 30, 2001

(65) Prior Publication Data

US 2002/0051023 A1 May 2, 2002

(30) Foreign Application Priority Data

Nov. 1, 2000 (JP) ..... 2000-335185
Oct. 25, 2001 (JP) ..... 2001-328302

(51) Int. Cl.[7] ..... B41J 2/15
(52) U.S. Cl. ..... 347/41; 347/14; 347/43
(58) Field of Search ..... 347/12, 9, 15, 347/41, 43, 14, 16

(56) References Cited

U.S. PATENT DOCUMENTS

| | | | | |
|---|---|---|---|---|
| 4,313,124 A | | 1/1982 | Hara | 346/140 R |
| 4,345,262 A | | 8/1982 | Shirato et al. | 346/140 R |
| 4,459,600 A | | 7/1984 | Sato et al. | 346/140 R |
| 4,463,359 A | | 7/1984 | Ayata et al. | 346/1.1 |
| 4,558,333 A | | 12/1985 | Sugitani et al. | 346/140 R |
| 4,608,577 A | | 8/1986 | Hori | 346/140 R |
| 4,723,129 A | | 2/1988 | Endo et al. | 346/1.1 |
| 4,740,796 A | | 4/1988 | Endo et al. | 346/1.1 |
| 4,999,646 A | * | 3/1991 | Trask | 346/11 |
| 5,384,587 A | * | 1/1995 | Takagi et al. | 347/41 |
| 5,717,448 A | * | 2/1998 | Inada | 374/43 |
| 6,260,938 B1 | * | 7/2001 | Ohtsuka et al. | 347/15 |
| 6,375,307 B1 | * | 4/2002 | Vinals et al. | 347/41 |
| 6,422,683 B1 | * | 7/2002 | Ogata | 347/41 |
| 2002/0021317 A1 | * | 2/2002 | Chikima et al. | 347/12 |

FOREIGN PATENT DOCUMENTS

| | | |
|---|---|---|
| JP | 54-56847 | 5/1979 |
| JP | 59-123670 | 7/1984 |
| JP | 59-138461 | 8/1984 |
| JP | 60-71260 | 4/1985 |
| JP | 4-33470 | 2/1992 |
| JP | 11-188898 | 7/1999 |

* cited by examiner

*Primary Examiner*—Stephen D. Meier
*Assistant Examiner*—Lam Nguyen
(74) *Attorney, Agent, or Firm*—Fitzpatrick, Cella, Harper & Scinto

(57) ABSTRACT

Images are printed with a reduced extent of a joint streak regardless of the type of a printing medium or the number of printing passes and a printing speed is increased without executing an unwanted thinning for correcting the joint streak. More specifically, printing method information added to print data is obtained, and it is determined on the basis of this information whether or not to execute a thinning process. Consequently, inter-band data correction process based on the thinning can be executed depending on the type of the print medium and the number of printing passes, thereby achieving an appropriate thinning depending on the type of the print medium or the like. When the thinning is not to be executed, all the processes related to the thinning can be omitted to prevent a decrease in printing speed.

29 Claims, 28 Drawing Sheets

| | GRADE → GOOD | | | |
|---|---|---|---|---|
| | ONE PASS | TWO PASSES | FOUR PASSES | SIX PASSES |
| ORDINARY PAPER | ON | ON | ON | |
| COAT PAPER | | ON | OFF | OFF |
| GLOSSY PAPER | | | OFF | OFF |
| GLOSSY FILM | | | OFF | OFF |
| ONE PASS | | | OFF | OFF |

PRINTING MODE TABLE

FIG.5A

| | GRADE → GOOD | | | |
|---|---|---|---|---|
| | ONE PASS | TWO PASSES | FOUR PASSES | SIX PASSES |
| ORDINARY PAPER | ON | ON | OFF | |
| COAT PAPER | | ON | OFF | OFF |
| GLOSSY PAPER | | | OFF | OFF |
| GLOSSY FILM | | | OFF | OFF |
| ONE PASS | | | OFF | OFF |

PRINTING MODE TABLE

FIG.5B

| THINNING LEVEL | COUNTER VALUE | THINNING RATE |
|---|---|---|
| 0 | 11111111 | 0/8 = 0% |
| 1 | 01111111 | 1/8 = 12.5% |
| 2 | 01110111 | 2/8 = 25% |
| 3 | 01010111 | 3/8 = 37.5% |
| 4 | 01010101 | 4/8 =50% |
| 5 | 00010101 | 5/8 = 62.5% |
| 6 | 00010001 | 6/8 = 75% |
| 7 | 00000001 | 7/8 = 87.5% |
| 8 | 00000000 | 8/8 = 100% |

FIG.14

CYAN INK UPPER

CYAN INK LOWER

MAGENTA INK UPPER

MAGENTA INK LOWER

YELLOW INK UPPER

YELLOW INK LOWER

CYAN INK UPPER

CYAN INK LOWER

MAGENTA INK UPPER

MAGENTA INK LOWER

YELLOW INK UPPER

YELLOW INK LOWER

FIG.17A

| (PRINTING DATA) | (COUNTER VALUE) |
|---|---|
| ○×○○○×○×××○○× | 01110111 |
| ORIGINAL DATA | |

FIG.17B

[FIRST PRINTING DATA]

| | |
|---|---|
| BEFORE PROCESSING | |
| ○×○○○×○×××○○× | 01110111 |
| AFTER PROCESSING | |
| ××○○○×○×××○○× | 11101110 |

FIG.17C

[SECOND PRINTING DATA]

| | |
|---|---|
| BEFORE PROCESSING | |
| ××○○○×○×××○○× | 11101110 |
| AFTER PROCESSING | |
| ××○○○×○×××○○× | 11101110 |

FIG.17D

[RESULT OF SMS THINNING PROCESS]

| | |
|---|---|
| ORIGINAL DATA | |
| ○×○○○×○×××○○× | |
| PROCESSED DATA | |
| ××○○○×××××○○× | |

FIG.18A (PRINTING DATA)
SHEET-DISCHARGING SIDE

| | | (COUNTER VALUE) |
|---|---|---|
| FIRST RASTER | ○○××○×○○ | 01110111 |
| SECOND RASTER | ○○××○×○× | |
| THIRD RASTER | ○○××○×○○ | 01010101 |
| FOURTH RASTER | ○○××○×○○ | |

SHEET-FEEDING SIDE

FIG.18B

[FIRST RASTER]

| | |
|---|---|
| BEFORE PROCESSING | |
| ○○××○×○○ | 01110111 |
| AFTER PROCESSING | |
| ×○××○×○× | 11101110 |

FIG.18C

[SECOND RASTER]

| | |
|---|---|
| BEFORE PROCESSING | |
| ○○××○×○× | 11101110 |
| AFTER PROCESSING | |
| ○○××○××× | 11101110 |

FIG.18D

[THIRD RASTER]

| | |
|---|---|
| BEFORE PROCESSING | |
| ○○××○×○○ | 10101010 |
| AFTER PROCESSING | |
| ○×××○××○ | 01010101 |

FIG.18E

[FOURTH RASTER]

| | |
|---|---|
| BEFORE PROCESSING | |
| ○○××○×○○ | 01010101 |
| AFTER PROCESSING | |
| ×○××××○× | 10101010 |

FIG.18F

| BEFORE PROCESSING | | AFTER PROCESSING |
|---|---|---|
| ○○××○×○○ | | ×○××○×○× |
| ○○××○×○× | → | ○○××○××× |
| ○○××○×○○ | | ○×××○××○ |
| ○○××○×○○ | | ×○××××○× |

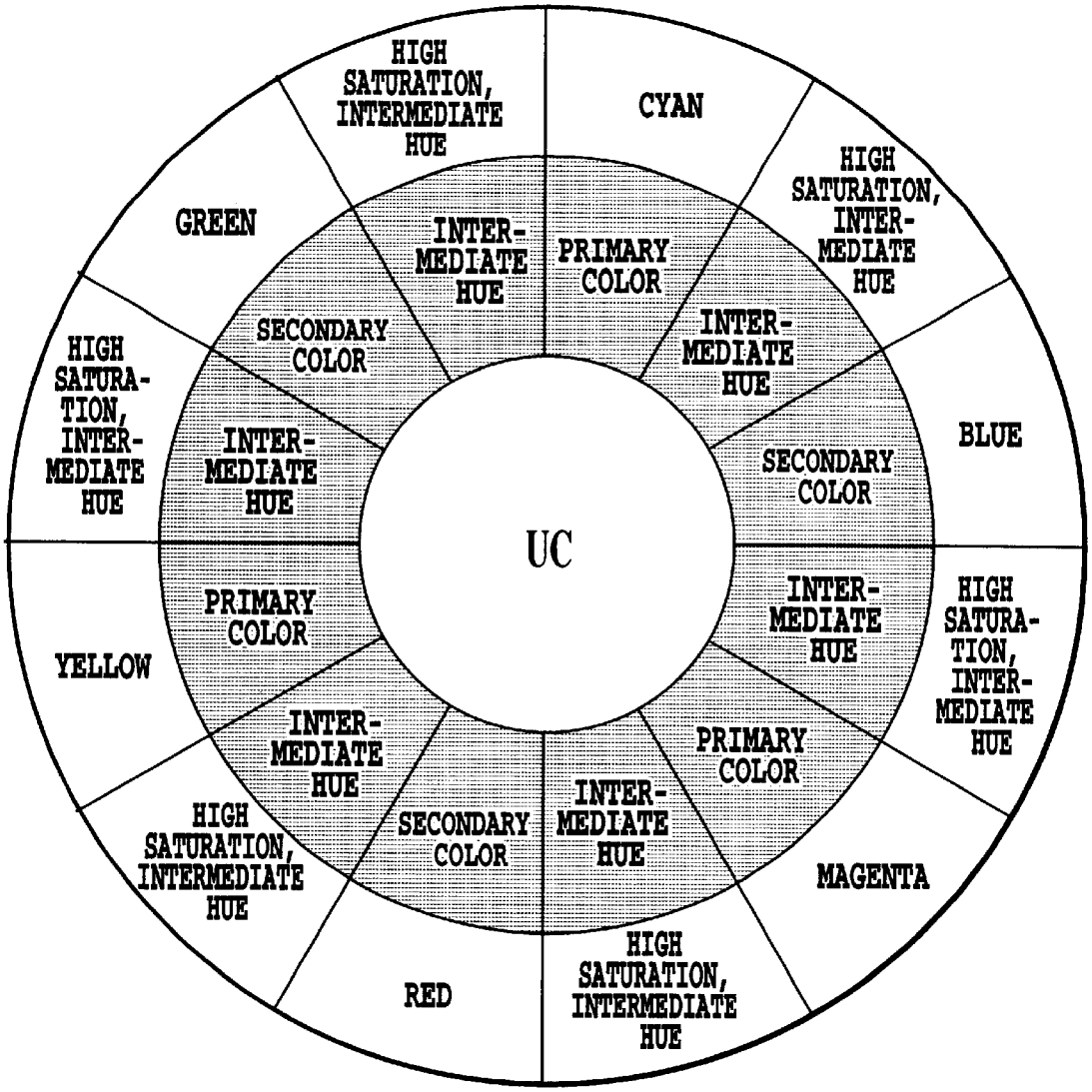
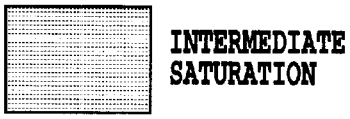
FIG.20

RESULT OF DETERMINATION : BLUE

CYAN INK_LOWER

CYAN INK_UPPER

MAGENTA INK_LOWER

MAGENTA INK_UPPER

YELLOW INK_LOWER

YELLOE INK_UPPER

RESULT OF DETERMINATION : RED

CYAN INK_LOWER

CYAN INK_UPPER

MAGENTA INK_LOWER

MAGENTA INK_UPPER

YELLOW INK_LOWER

YELLOE INK_UPPER

INK JET PRINTING APPARATUS AND INK JET PRINTING METHOD

This application is based on Patent Application Nos. 2000-335185 filed Nov. 1, 2000 and 2001-328302 filed Oct. 25, 2001 in Japan the content of which is incorporated hereinto by reference.

BACKGROUND OF THE INVENTION

1. Field of the Invention

The present invention relates to an ink jet printing apparatus and an ink jet printing method, and specifically, to reduction of an unevenness of density such as what is called black streaks, which may occur at a joint between scanning areas or a neighbor of the joint when printing each of these areas, the printing of each area being completed by scanning a printing head on the each area one or more times.

2. Description of the Related Art

Recently, user's needs of a high-speed printing operation is increased in printing apparatuses such as ink jet printers, in which ink is ejected to a printing medium for printing. On the other hand, as one of methods for improving print quality, what is called multi-pass printing system is known, which completes printing for a predetermined area by scanning a printing head (this scanning operation in the multi-pass system is hereinafter also referred to as "pass") to the predetermined area a plurality of times to effectively improve the quality. A method of direct achieving the printing, which makes much of high-speed printing operation, in the multi-pass printing system is to reduce a number of passes.

This is easily understood because in a condition that the number of ejection openings in the printing head is fixed, an amount of paper fed at a time decreases with an increase in the number of passes, while the amount of paper fed at a time can be increased by reducing the number of passes. If for example, printing for the area which otherwise can be printed with two passes is executed with one pass, the printing speed can be simply doubled and increased. More specifically, the smaller the number of passes in the multi-pass printing system, the less the number of scanning operations of the printing head required to print a predetermined area (for example, one sheet of printing medium) is, and the more the amount of paper fed at a time is. Then, the time required for printing the predetermined area decreases.

In the case that the printing head provided with a plurality of ejection openings that eject ink (printing liquid) is scanned in a direction perpendicular to an arrangement direction of the ejection openings so as to perform printing, a band-shaped scanning area (hereinafter also referred to as a "band"), width of which is the same as the arrangement width of the ejection openings, as shown in FIG. 24 is defined as an area to which one scanning operation is executed. When printing for this band is performed with one pass, an amount of ink ejected at one scanning operation to a unit area of a printing medium (hereinafter the amount can be expressed by the number of dots formed on the unit area and the amount is referred to as the "duty") is larger than that in the multipass printing in which printing for one band is performed with two or more times of scanning operations. Owing to this greater amount of ink, the one-pass printing system easily causes what is called a black streak, which is caused as a portion of higher density at a boundary between the bands (herein after simply referred to as "joint") or at vicinity of the joint, especially at a portion of high duty printing data in the scanning area though the conspicuousness of the black streak varies depending on the nature of printing medium or liquids. This is because when the duty is high so that the amount of ink is large, the ink may flow (bleed) from one band to another band to form the high density portion, as described later for FIG. 16.

This black streak also occurs conspicuously in a system having head arrangement called a "lateral arrangement" in which the printing heads ejecting a plurality of different print inks (cyan, magenta, yellow, and the like) are arranged in their scanning direction. This is because the joints for all the inks occur at the same location. FIG. 9 schematically shows the lateral arrangement of printing heads. In the case that printing is performed by means of all the ejection openings of the respective printing head of this lateral arrangement, the ejection openings in the printing heads of the respective color inks are scanned to the same area. Thus, the position of the joint cannot be differentiated for each color ink either in the one-pass printing or the multipass printing. As a result, an amount of ink ejected to the vicinity of the joint become large as same as to another area in the band. In the example shown in FIG. 9, the amount corresponds to an amount of three color inks, that is, Y, M, and C inks. Accordingly, an amount of ink flown into from the adjacent band becomes large, resulting in more noticeable black streaks.

The black streak, which occurs at the boundary between bands or at the vicinity of the boundary as described above are also called a "joint streak" or a "banding". In case that the joint streak is conspicuous, the print quality may be such that printed materials obtained cannot be put to practical use.

On the other hand, methods of reducing such joint streak in the one-pass printing to improve the image quality have been proposed.

For example, Japanese Patent Application Laid Open No.11-188898 discloses a method of thinning printing data, in which when completing printing of an image one band by one band by scanning the printing head repeatedly in a main scanning direction, at least one of a first raster or a last raster in printing data for one band is divided into unit areas each consisting of a predetermined number of pixel and printing data for each unit area is thinned in a manner that an ejection amount of object color ink of thinning process and an ejection amount of another color inks are calculated based on printing data of the unit area and based on the sum of calculated amount printing data is thinned so as to decrease the ejection amount of the object color ink.

Further, Japanese Patent Application Laid Open No. 04-33470 proposes a method of identifying a printing medium used for printing and varying a correction amount for printing data on based on the result of the identification.

However, the conventional methods of reducing the joint streak can not provide a sufficiently accurate control of thinning especially in relation to a kind of the printing medium used for printing or the number of passes in the multipass printing system. Consequently, the conventional methods may execute an unwanted thinning process or undergo a reduced printing speed owing to this thinning process.

For example, an increase in the number of passes generally reduces occurring of the joint streak. However, when this increasing the number of passes is simply applied in the case of using ordinary paper, the effect of the thinning process may become so high that a white streak inversely occurs to degrade the printed image. Further, depending on the printing medium used or the number of passes for the multipass printing, there is a case that a correction by means of the thinning process is not required. The correction for the printing data may be executed even if this correction is not required, thereby reducing the printing speed.

SUMMARY OF THE INVENTION

The object of the present invention is to provide an ink jet printing apparatus and an ink jet printing method which can print color images with decreased joint streaks regardless of a type of the printing medium or the number of passes and can prevent a printing speed from decreasing when no correction for the joint streak are required.

In the first aspect of the present invention, an ink jet printing apparatus using a printing head and relatively scanning the printing head to a printing medium to perform printing by ejecting a plurality of colors of ink from the printing head, the apparatus comprising:

determining means for determining whether to reduce an amount of ink to be ejected to a vicinity of a joint in a band on the printing medium, the band being defined by the joint and defined as an area printed by scanning the printing head, based on printing method information added to printing data; and printing control means for when the determining means determine to reduce the amount of ink, correcting the printing data so that the amount of ink ejected to a predetermined area in the vicinity of the joint during the scanning is decreased at a decreasing rate corresponding to an amount of ink to be ejected based on the printing data, and controlling the printing apparatus to perform printing according to a printing method designated by the printing method information, based on the corrected printing data, and when the determining means determine not to reduce the amount of ink, controlling the printing apparatus to perform printing according to a printing method designated by the printing method information, based on the printing data without executing correcting of the printing data for decreasing an amount of ink ejected during the scanning.

In the second aspect of the present invention, an ink jet printing method using a printing head and relatively scanning the printing head to a printing medium to perform printing by ejecting a plurality of colors of ink from the printing head, the method comprising the steps of:

determining whether to reduce an amount of ink to be ejected to a vicinity of a joint in a band on the printing medium, the band being defined by the joint and defined as an area printed by scanning the printing head, based on printing method information added to printing data; and when the determining step determine to reduce the amount of ink, correcting the printing data so that the amount of ink ejected to a predetermined area in the vicinity of the joint during the scanning is decreased at a decreasing rate corresponding to an amount of ink to be ejected based on the printing data, and controlling the printing apparatus to perform printing according to a printing method designated by the printing method information, based on the corrected printing data, and when the determining step determine not to reduce the amount of ink, controlling the printing apparatus to perform printing according to a printing method designated by the printing method information, based on the printing data without executing correcting of the printing data for decreasing an amount of ink ejected during the scanning.

In the third aspect of the present invention, a data processing method used in an ink jet printing apparatus using a printing head and relatively scanning the printing head to a printing medium to perform printing by ejecting a plurality of colors of ink from the printing head, the method comprising the steps of:

determining whether to reduce an amount of ink to be ejected to a vicinity of a joint in a band on the printing medium, the band being defined by the joint and defined as an area printed by scanning the printing head, based on printing method information added to printing data; and when the determining step determine to reduce the amount of ink, correcting the printing data so that the amount of ink ejected to a predetermined area in the vicinity of the joint during the scanning is decreased at a decreasing rate corresponding to an amount of ink to be ejected based on the printing data, and controlling the printing apparatus to perform printing according to a printing method designated by the printing method information, based on the corrected printing data, and when the determining step determine not to reduce the amount of ink, controlling the printing apparatus to perform printing according to a printing method designated by the printing method information, based on the printing data without executing correcting of the printing data for decreasing an amount of ink ejected during the scanning.

According to the above configuration, the printing method information, which is added to the printing data, enables the identification of, for example, a type of the print medium and the number of times of scanning operations required to complete printing a band, and then, it can be determined on the basis of the result of the identification whether or not to reduce the amount of ink landing on the vicinity of a joint. When it is determined that the amount of ink landing on the vicinity of the joint is to be reduced, a printing operation is executed according to the printing method indicated by the printing method information, and a process is executed so that the amount of ink ejected during the scanning operation is reduced at a reduction rate corresponding to the amount of ink landing on a predetermined area in the vicinity of the joint on the basis of the printing data. On the other hand, when it is determined that the amount of ink is not to be reduced, the printing operation is executed according to the printing method indicated by the printing method information without reducing the amount of ink ejected during the scanning operation. Consequently, in the case that the amount of ink is to be reduced, a proper ink amount reduction, which agrees with the type of the printing medium and the number of times of scanning operations indicated by the printing method information, can be executed. On the other hand, when it is determined that the amount of ink is not to be reduced, the restraint of the occurrence of the streak can be achieved by performing the printing operation according to the printing method with no process for reducing the amount of ink. Furthermore, an unwanted process for reducing the amount of ink can be avoided.

The above and other objects, effects, features and advantages of the present invention will become more apparent from the following description of embodiments thereof taken in conjunction with the accompanying drawings.

BRIEF DESCRIPTION OF THE DRAWINGS

FIGS. 5A and 5B are views showing tables used in the determination process of the first embodiment, shown in FIG. 4;

FIG. 14 is a view showing an example of a counter value for an SMS process according to the first embodiment;

FIGS. 17A–17D are views illustrating printing data processing based on the SMS process according to the first embodiment;

FIGS. 18A–18F are views illustrating printing data processing based on the SMS process according to the first embodiment;

FIG. 20 is a view showing an example of the division of color areas according to the second embodiment;

DETAILED DESCRIPTION OF PREFERRED EMBODIMENTS

Figure 1:
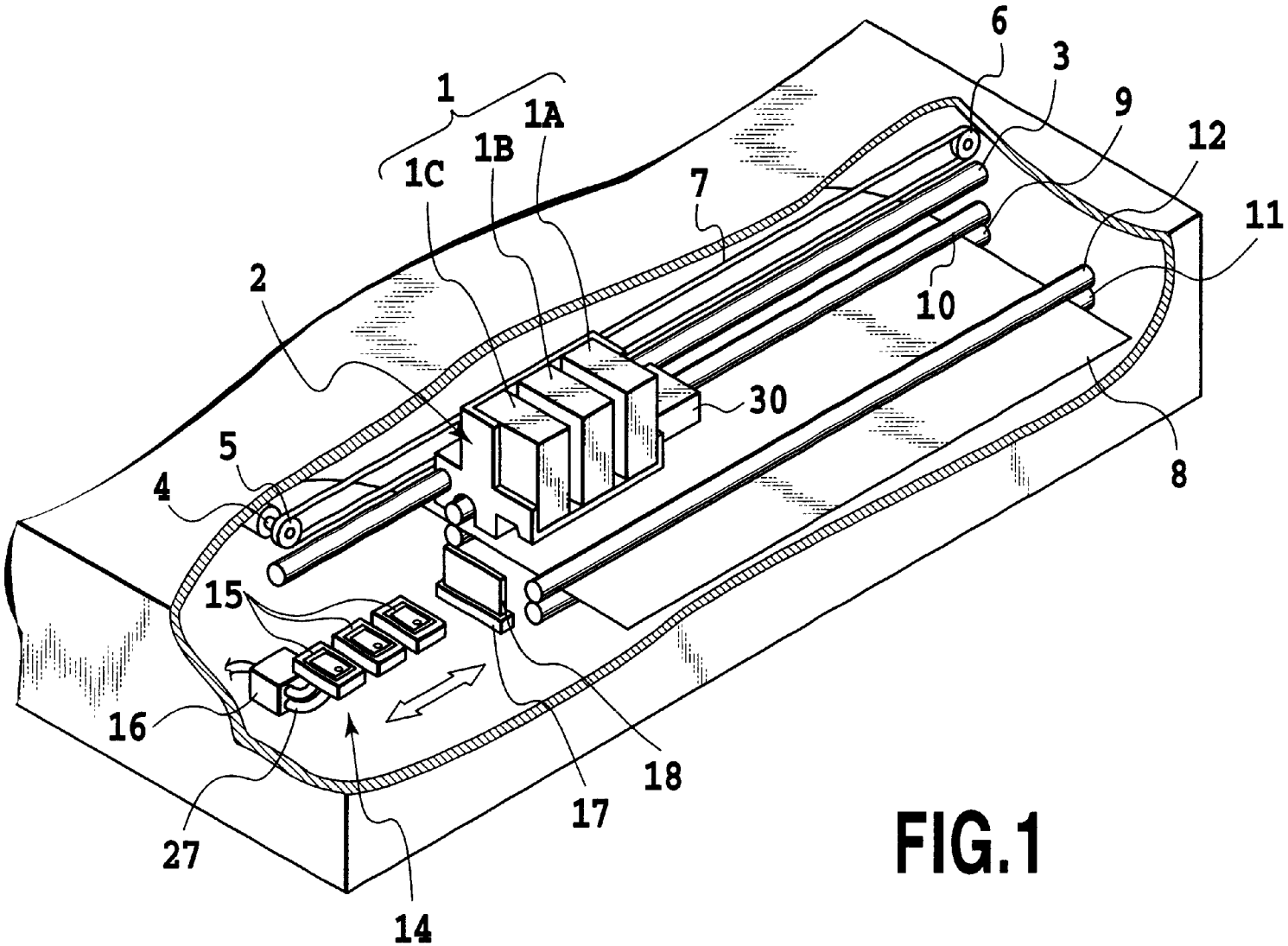
FIG. 1 is a perspective view schematically showing the construction of an ink jet printing apparatus according to an embodiment of the present invention.

Embodiments of the present invention will be described in detail below with reference to attached drawings.

It should be noted that a "black streak" described below means a "streak" observed as a high-density portion at a boundary between scanning areas of a printing head. Further, a white portion in a printed image, which is observed as a streak, is called "white streak".

One embodiment of the present invention identifies a printing medium and the number of passes for the one-pass or multipass printing. Then, a thinning process for printing data (also referred to as "ejection data" as a final form of the printing data which is supplied to a head driver) of the vicinity of a joint is controlled according to the identified printing medium and the number of passes. Specifically, whether or not the thinning process is required is determined based on the identified kind of printing medium and the number of passes. Then, when it is determined that the thinning process is required, the thinning is executed at a thinning amount corresponding to the total amount of ink applied to the vicinity.

Furthermore, when setting the thinning amount of the printing data based on the total amount of ink, a color area consisting of a hue or both the hue and a saturation is determined and the controlling of the thinning process is differentiated for each color area, in view of a fact that a way of streak appearance and the effect of the thinning process vary depending on a printed color.

Specifically, the printing data for the vicinity of the joint, which is a part of printing data for one band, is divided into data for predetermined unit areas. The number of ejections (hereinafter referred to as the "number of dots") of respective ink colors is counted for each unit area and then the color area (described later) for each unit area is determined based on the dot count value of the respective ink colors. Then, correspondingly to the determined color area, a thinning rank for a thinning process area is determined for each ink color based on the dot count value for each unit area (or duty) as obtained by summing the dot count values for each ink color and a given thinning rank graph. Subsequently, an SMS thinning process, described later, will be executed.

Principle arrangements for this embodiment, outlined above, will be described below.

Identification of a Printing Medium and the Number of Passes

The occurrence of the joint streak is greatly affected by an ink absorption characteristic of the printing medium or the amount of ink landing on a unit area of the printing medium. In general, the printing media used in ink jet printing apparatuses mainly include an ordinary paper, a coat paper, a glossy paper, a glossy film and an OHP paper. These printing media have different ink absorbing characteristics. Among them, the ordinary paper allows ink to permeate therethrough at the highest speed, so that in the vicinity of the joint between adjacent bands, the ink after landing on one of the bands is likely to flow, as a permeating action, into the ink before landing on the other band. Thus, the ordinary paper is easily subject to an occurrence of the black streak.

In two-pass printing as one of the multipass printing method, the amount of ink landing on the printing medium during one pass is approximately half the amount in the case of the one-pass printing. Accordingly, the above-described inflow of ink is restrained, and the streak is less likely to occur than in the one-pass printing. If the number of passes is thus increased, then, for example, in four-pass printing, the inflow of ink is restrained without the need to execute a correction for the streak at the joint. Inversely, if the correction for the joint streak is executed on the basis of the thinning, then a white streak may occur to degrade the print grade. In this manner, depending on the number of passes, the black streak, which is enough to degrade the image grade, may not occur even without the correction for the joint streak. Thus, in the embodiment, the number of passes set for printing is identified and it is determined whether or not to execute a joint streak correction (the correction for the joint streak) in accordance with a result of the identification. This prevents the image grade from lowering owing to black streaks and white streaks resulting from unwanted corrections.

Further, of the above printing media used for printing, the glossy paper and film have an ink receiving layer in the surface of the paper to limit the permeation of ink to a shallow portion in the surface of the paper, thereby achieving a high density and high color development. If such a printing medium is used for the one-pass printing of high duty, a large amount of ink lands on the medium per unit time and then overflow of ink (bleeding) is likely to occur on the surface of the medium. Thus, the multipass printing method is used to limit the amount of ink ejected per unit time. In the case that the multi-pass printing is carried out on a print medium with the ink receiving layer as described above, the joint streak is unlikely to occur, thereby eliminating the needs for the joint streak correction. Further, the printing speed is prevented from decreasing if a series of processes related to the joint streak correction is not executed. Thus, in the embodiment, the printing medium used for printing is also identified and it is determined whether or not to execute the joint streak correction, on the basis of the result of the identification.

Thinning Process Area

Figure 8A:
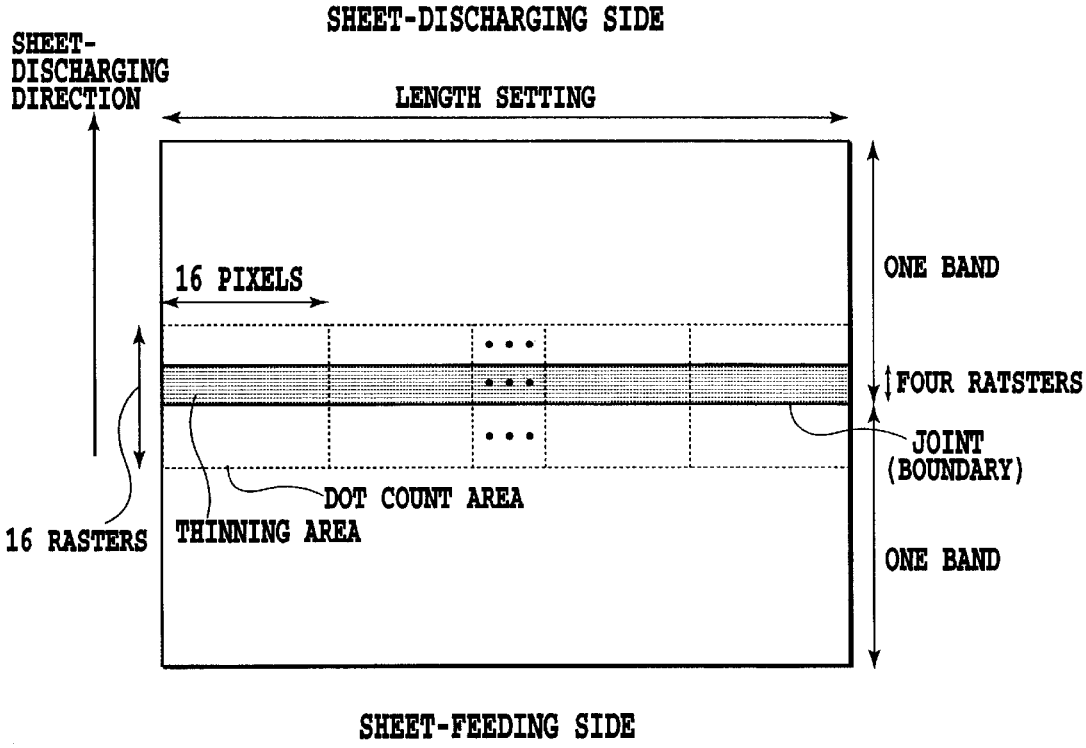
FIGS. 8A and 8B are views illustrating an area in which dots in printing data are counted and an area in which the thinning is carried out, according to the first embodiment.

A thinning process area in which the thinning process is executed is composed of several rasters (in the example in FIG. 8A, four rasters) in one of respective near joint areas of adjacent bands, between which a boundary of the adjacent bands lies, as shown in FIG. 8A. In the example shown in FIG. 8A, the thinning process area is composed of four rasters in the near joint area of the band to which a scanning operation is previously executed. It should be noted that the present invention is not limited to this embodiment and the thinning process may be executed on the subsequently scanned band or both bands. In order to coop with drawing of ink on the vicinity of the joint in the band, to which the scanning operation is subsequently executed, into a portion of the previously scanned band in which fixing of ink to the medium is being progressed with slightly bleeding of ink, it is only necessary to perform reduction of the amount of ink landing on the vicinity of the joint. That is, it is only necessary to thin the printing data to reduce the amount of drawn ink into the vicinity in the previously scanned band. It should be noted that, when the thinning is executed for several rasters, the level of the thinning (in this embodiment, a rank graph, described later) may be set independently for each raster or in the units of smaller rasters so as to, for example, increase the level of the thinning with a decrease in the distance to the joint, thereby increasing the accuracy of the thinning or the thinning process.

Dot Count Area

An area for which dot count is executed lies in an area, which is formed by repeating a unit area of 16 rasters×16 pixels in the scanning direction, in the adjacent bands between which the boundary lies, as also shown in FIG. 8A. As described later in detail, the size of this area is set larger than the area of the above-described thinning process area and counting the dots is executed for the printing data of the both bands adjacent to each other and including the joint. Therby, the status of bleeding in the vicinity of the joint can be appropriately determined.

Thinning Process Method

In this embodiment, a thinning method called "SMS (Sequential Multi Scan) thinning process" is used to thin the printing data. Other available thinning process methods use pattern masks or error diffusions (ED).

Figure 25A:
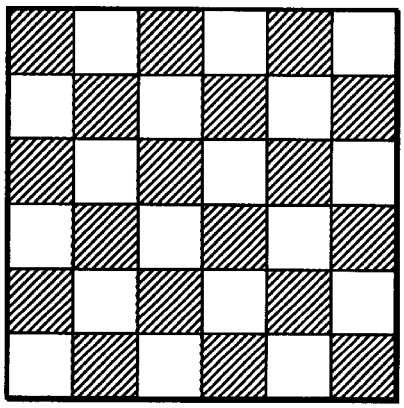
FIGS. 25A–25E are conceptual drawings illustrating a thinning process using a mask according to the embodiment of the present invention.
Figure 25B:
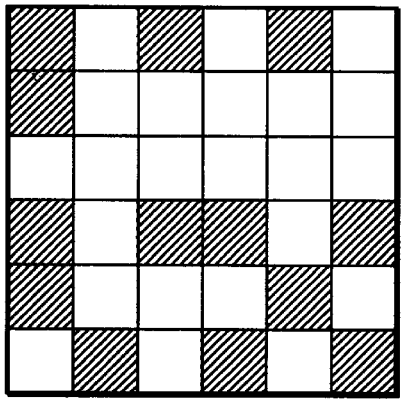
Figure 25C:
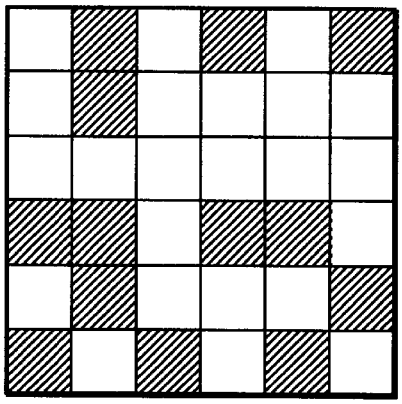
Figure 25D:
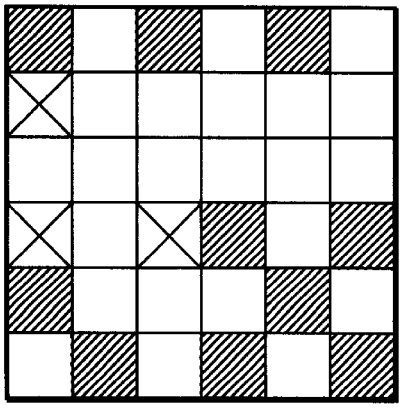
Figure 25E:
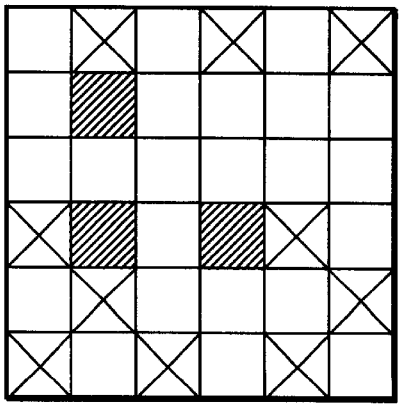

However, with pattern mask method, for example, as shown in FIG. 25A, in the case that a staggered (checker pattern) thinning mask is used (the data in the white squares is thinned) to execute the thinning process for respective printing data, in which inks are ejected to different pixels and amounts of ink landing to the medium (the duty) is equal as shown in FIGS. 25B and 25C, the processed data becomes what is shown in FIGS. 25D and 25E, wherein the printing data for the pixels shown with a sign "x" are thinned. As seen from these two figures, for printing data with the same amount of ink ejected (the duty), the thinned amount differs depending on the printing data (arrangement of the pixels). Consequently, in some cases, the amount of data thinned cannot be even controlled.

Further, the ED-based thinning method may comprise, for example, the following processes: When any pixel on which a process for a quantized-image-data is executed has data to be printed, a multivalue is assigned to the pixel on the basis of a predetermined nozzle correction value.

An error from a surrounding pixel is added.

It is determined on the basis of a comparison with a predetermined threshold value whether or not to thin the printing data for the pixel.

An error resulting from the determination is calculated.

The error is allotted to predetermined surrounding pixels.

When any pixel on which a process for a quantized-image-data is executed has no data to be printed, an error from a surrounding pixel is obtained and allotted to predetermined surrounding pixels.

The error is allotted to the pixels in a scanning direction of the joint streak process and to at least one of the pixels in a data row to be processed next to the data row being currently processed.

However, when such a thinning process is applied to a printing operation in which especially the one-pass printing is carried out using a printing head provided with nozzles arranged at high density, which head is becoming more and more popular, it may be required relatively much time to execute the thinning process due to a large number of nozzles and thus a large amount of printing data. As a result of this, the printing operation is suspended owing to the thinning process, thus hindering the faster printing based on the one-pass printing.

Thus, in order to achieve even controlling the amount of thinned data and increasing of the processing speed, the embodiment employs the SMS thinning process. Here, the SMS thinning process is that an object pixel of processing is sequentially sifted and the processing is executed as follows. For the pixel having printing data (ejection data is "1"), a count value (a particular bit, for example, the MSB) designated by a counter (register) is read. When the count value is "1", the printing data is not thinned (ejection is performed), while when the count value is 0, the printing data is thinned (ejection is not performed). Then, the counter shifts to the next position on the right (the bit is shifted). Once the counter reaches its rightmost position, it returns to its leftmost position (the bit is cyclically shifted). This process is repeated for each pixel having printing data, thus determining the thinned dots (thinning the printing data). In this manner, whether or not to execute the thinning is determined for only the pixels having printing data, thereby preventing the thinning process from falling in with the printing data pattern.

Thinning Table

Figure 26A:
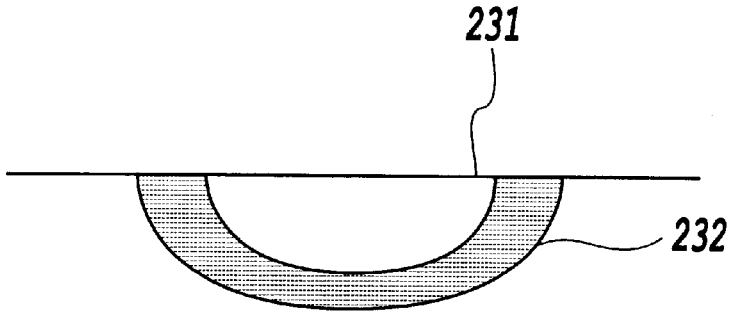
FIGS. 26A and 26B are conceptual drawings illustrating ink on a printing medium according to the embodiment of the present invention.
Figure 26B:
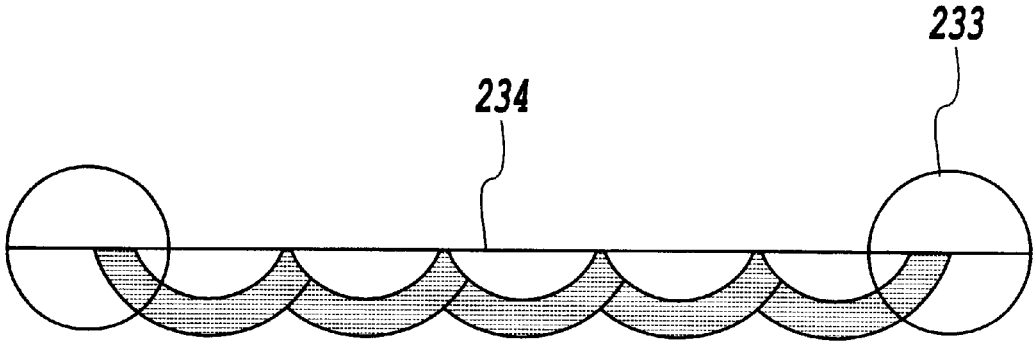

Developing of color at an end part of printing may differs from the other parts depending on the order of ejection of inks used as ejected onto a printing medium. FIGS. 26A and 26B schematically show example of the permeation of the ink through the printing medium. Of course, how ink permeates through the printing medium varies depending on the types of the inks used, the printing medium used, a printing environment, time differences between ink ejection operations, or the like.

As shown in FIGS. 26A and 26B, the subsequently ejected ink 232 normally enters under the previously ejected ink 231. In this manner, the different inks landing on the same location of the printing medium are not completely mixed to develop a color, but develops a color in a state as shown in FIG. 26A. In this case, a printing end part 233 shown by the circle in FIG. 26B develops a color different from that of an inner part 234, indicating that the subsequently ejected ink has a stronger color development. This color difference also promotes the occurrence of the joint streak. Thus, using the same thinning rate for the previously ejected ink and the subsequently ejected ink cannot eliminate the streak due to the difference in color.

Thus, in the embodiment, the thinning rate is determined by considering the landing order of the inks on the printing medium.

Next, a thinning rank graph, used to determine the thinning rate according to the embodiment, will be described. An example of the graph is shown in FIG. 13A.

The thinning rank graph is provided for each ink color and shows thinning rates (the thinning ranks) corresponding to the number of counted dots in the dot count area. The thinning rank graph can be specified using a combination of three parameters: a start dot number, a dot interval, and a MAX rank. Further, the thinning rates derived from the thinning rank graph are previously determined. For example, in the embodiment, nine rates including 0%, 12.5%, 25%, 37.5%, 50%, 62.5%, 75%, 87.5%, and 100% are set as the thinning rate and from these rates the thinning rate is determined corresponding to the dot count value.

Each of the parameters will be described. First, the start dot number means a total dot count value obtained when the thinning rate of 12.5% (thinning rank 1) starts to be used. Further, the dot interval means the number of dots counted before the thinning rate shifts to the next one (for example, from 12.5% to 25%), that is, the range of dot counts within which the same thinning rate is used. The MAX rank designates a maximum thinning rate. No thinning rate above the MAX rank is selected, and once the thinning rate reaches the MAX rank, the thinning rate is not increased even with a subsequent dot count value corresponding to the dot interval, with the thinning rank maintained at the MAX rank.

Since the thinning rank, that is, the thinning rate can thus be set using the three parameters, one thinning rank graph can be represented as 1-byte (8-bit) data by, for example, setting the start dot number with 3 bits (8 levels), the dot interval with 3 bits (8 levels), and the MAX rank with 2 bits (4 levels).

To increase the resolution of each parameter, the number of bits for the parameter may be increased. Alternatively, the parameters can be more accurately set by using the same number of bits and providing 1 byte of offset available for the thinning rank graph, for each of the start dot number, the dot interval, and the MAX rank.

It is a very effective for the embodiment that the amount of data required to set the thinning rank graph can thus be reduced to achieve a reduction of the data amount. This is because in a printing mode such as the one-pass printing which focuses on the printing speed, it is difficult to use software to execute joint processing as in this embodiment, and hardware is thus desirably used instead. More specifically, when software is used for the data processing, data cannot be generated to match with the scanning speed of the printing heads. Consequently, the process must stop and wait for printing data, thereby decreasing the printing speed. Thus, hardware, for example, a gate array is desirably used for the processing. However, since the number of data required is directly reflected in the number of gates, the number of data is desirably smaller in connection with the scale of the circuit.

Figure 13B:
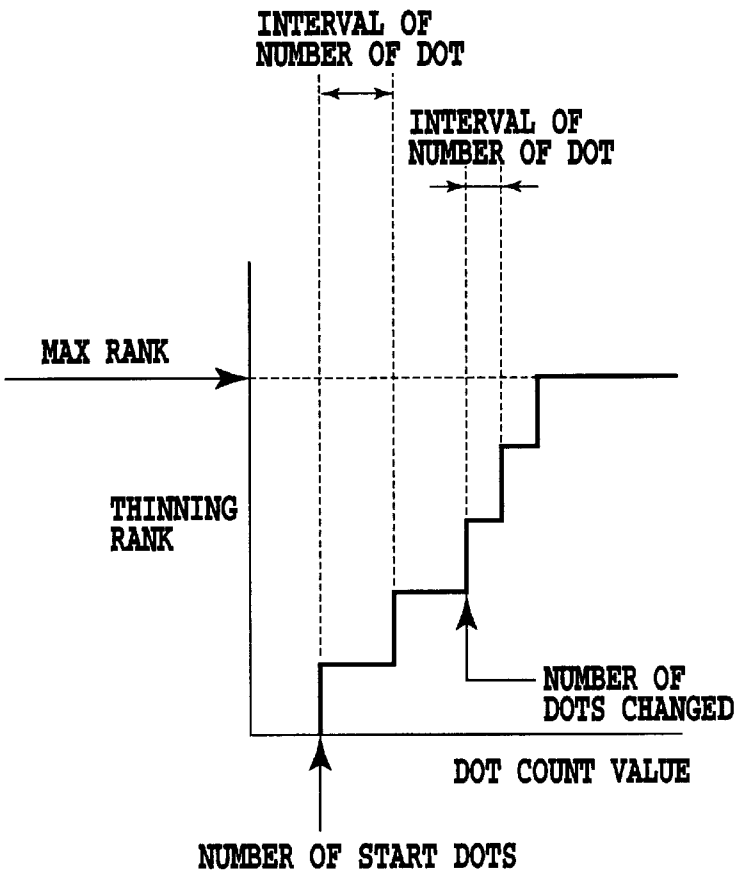
FIGS. 13A and 13B are views showing examples of thinning rank graphs according to the first embodiment.
Figure 13A:
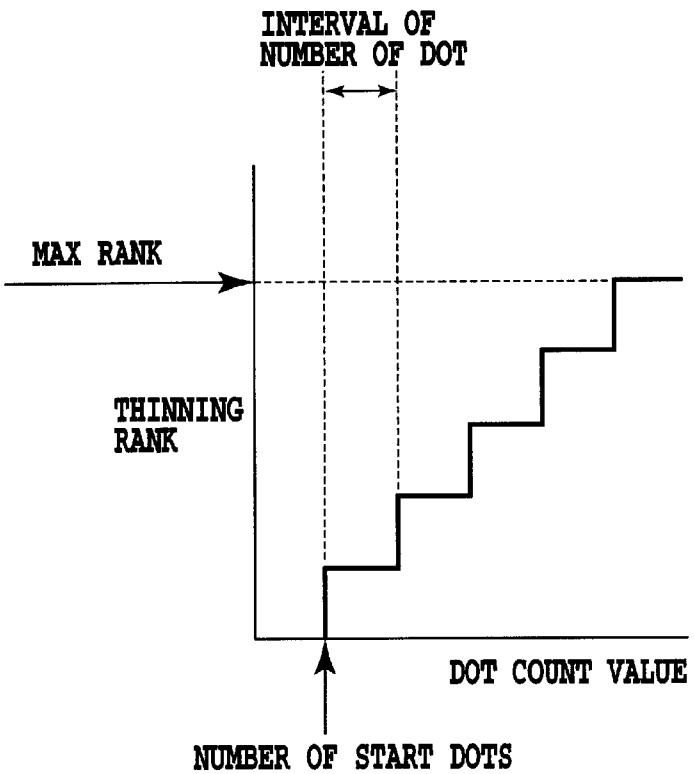

Another example of thinning ranks is shown in FIG. 13B. This example is effective when the change rate of the thinning rank, which is dependent on the dot count value, is to be changed.

More specifically, in this example, in addition to the three parameters required to described the thinning rank, a changing dot number indicating the start point of the change of the change rate and a dot interval 2 specifying a subsequent change rate are used to specify a second rank change rate. Such parameter settings enable more accurate processing.

Determination of a Color Area

In general, the behavior of ink on a printing medium when performing printing varies depending on the relation between the ink and the printing medium. Further, how the joint streak appear and the effect of the thinning process on the reduction of the joint streak vary depending on a printing color.

For example, in a color change from white through blue to UC (Under Color, a mixture of Y, M, C inks), cyan ink and magenta ink are used for printing before the color turns to blue, and once maximum saturation or maximum gradation of blue is reached, the cyan and magenta data become data for solid printing (data of a maximum duty). In this color of maximum point of blue, a certain higher level of thinning is applied to the printing data of cyan and magenta inks according to the above-described determination of the thinning rates.

A case will be considered in which the same thinning parameters are applied to, for example, a color change from white through red to UC. In this case, at a point where a color of a maximum gradation or maximum saturation of red begins to turn to UC, the cyan ink starts to be used. The amount of ink ejected at this point corresponds to data of a maximum duty for each of magenta and yellow. Since this duty equals that of the maximum point of blue observed in the above-described color change from white through blue to black when blue starts to turn to UC, the high thinning rate applied to cyan and magenta is used for the thinning. Thus, the dots for cyan, which have not been densely arranged yet since the start of the use of this color, are thinned, resulting in the noticeable missing of cyan dots.

Accordingly, in the embodiment, in addition to the total amount of ink (dots) applied to a unit area in the vicinity of the boundary, which is an end part of a band in connection with the scanning of the printing heads, information on a hue or the hue and a saturation of this unit area and on the colors of the ink used for printing is obtained and the thinning rate is set according to this information. Thus, in the embodiment, the hue or both the hue and saturation of a target area (the unit area) to be printed is determined based on the dot count value for each ink color. The hue, or a combination of the hue and saturation is called a "color area" in the present specification.

According to the embodiment described above, the execution of the thinning process is controlled correspondingly to the type of the printing medium and the number of passes required to complete printing the band, thereby preventing an excessive level of thinning that may create another joint streak depending on the type of the printing medium and the number of passes used. Then, printing can always be executed with a reduced amount of the joint streak regardless of the setting for the type of the printing medium or for the number of passes.

Further, in the embodiment described above, the color area of an object unit area of processing is determined based on the number of printing data (the number of dots formed) and the thinning rank (level of the thinning) can be set for each ink color used and for each printing location on the basis of the determined color area. Then, the thinning process for each ink color of ink is executed by using the thus set thinning rank, thereby the level of the joint streak occurring between the bands during the one-pass printing operation can be reduced.

Other Embodiments

In the above-described embodiment, in setting the thinning rate (the thinning rank), it is determined from the dot count value for a predetermined area, and the color area is also determined and reflected in the determination of the thinning rate. However, it should be appreciated that the application of the preset invention is not limited to this method. For example, even if the color area is not considered in setting the thinning rate, appropriate printing can also be achieved with a reduced amount of joint streaks regardless of the type of the print medium or the number of passes, by determining whether or not to execute the thinning depending on the type of the print medium and the number of passes and by setting the thinning rate on the basis of the dot count if the thinning is to be executed.

Concrete examples of the embodiments, in which the present invention is applied to an ink jet printer, will be described in detail with reference to the drawings. In the figures, elements are denoted by the same reference numeral are the same or correspond to each other.

First Example

A first example relates to an ink jet printer which ejects inks from a plurality of printing heads to perform printing.

Example of the Construction of the Printer

FIG. 1 is a schematic perspective view showing the construction of an essential part of an example of an ink jet printer to which the present invention has been applied. In FIG. 1, a plurality of (three) head cartridges 1A, 1B, and 1C are replaceably mounted in a carriage 2. Each of the cartridges 1A to 1C has a printing head part and a connector provided therein to receive a signal that drives the printing head part. In the following description, when all or one of the head cartridges 1A to 1C are or is referred to, they are or it is simply denoted as a printing means (printing head or head cartridge) 1.

The plurality of cartridges 1 eject inks of different colors, and each have an ink tank part storing corresponding ink. The respective ink tank parts store different color inks such as cyan, magenta, or yellow, for example. Each printing means 1 is positioned and replaceably mounted in the carriage 2, which has a connector holder (electric connection part) that transmits a drive signal and other signals to the printing means 1 via the above-mentioned connectors.

The carriage 2 has its movement guided by a guide shaft 3 installed in a printer main body along the main-scanning direction. The carriage 2 is driven by a main-scanning motor 4 via a motor pulley 5, a driven pulley 6, and a timing belt 7 so that its position and movement are controlled. A printing material 8 as a printing medium such as a printing sheet or a thin plastic sheet is transported through a location (printing section) opposing to an ejection opening surface of the printing head 1 when two transportation rollers are rotated. The printing material 8 has its back surface supported by a platen (not shown) so as to form a flat printing surface in the printing section. In this case, the cartridges 1, mounted in the carriage 2, are held so that the ejection opening surfaces thereof project downward from the carriage 2 and stand flat over the printing material 8 between the transportation rollers.

The printing head 1 is an ink jet printing means for ejecting ink using thermal energy and comprises an electrothermal converter that generates the thermal energy. More specifically, the printing head 1 ejects ink through the ejection openings (herein after also referred to as "nozzles") by a change in pressure upon growth and contraction of a bubble resulting from film boiling caused by the thermal energy generated by the electrothermal converter.

Figure 9:
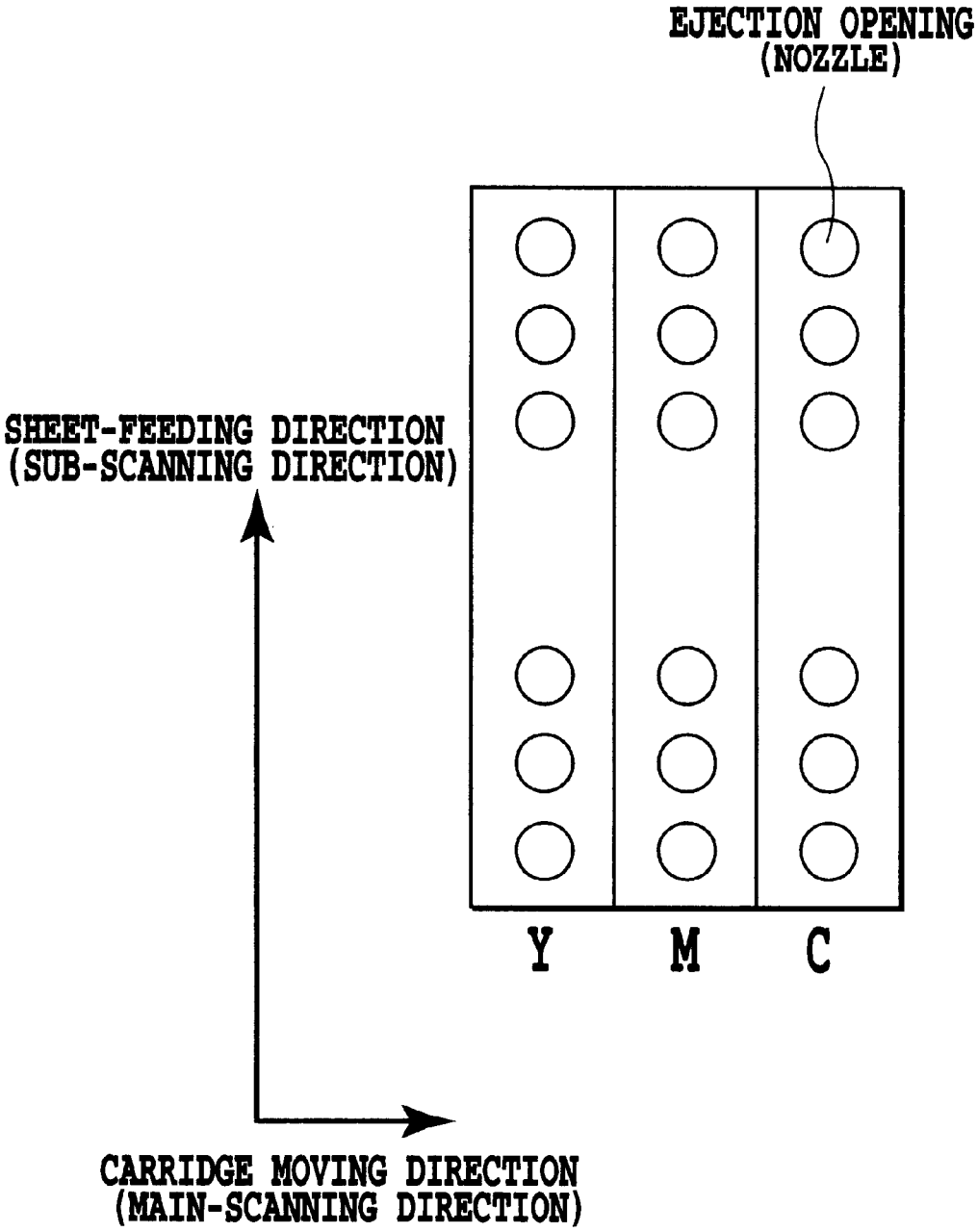
FIG. 9 is a schematic view showing the construction of a printing head used in the printing apparatus of the first embodiment.

FIG. 9 shows the construction of nozzles in the plurality of printing heads used in this example. As shown in this figure, the printing heads 1 are each used for a corresponding one of the yellow ink (Y), magenta ink (M) and cyan ink (C), and each have a plurality of nozzles. The nozzles in each printing head are arranged in a transportation direction (sheet discharging direction) of the printing material 8, whereas the printing heads provided with these nozzles are scanned in the main scanning direction, which is substantially orthogonal to the array of nozzles.

Figure 2:
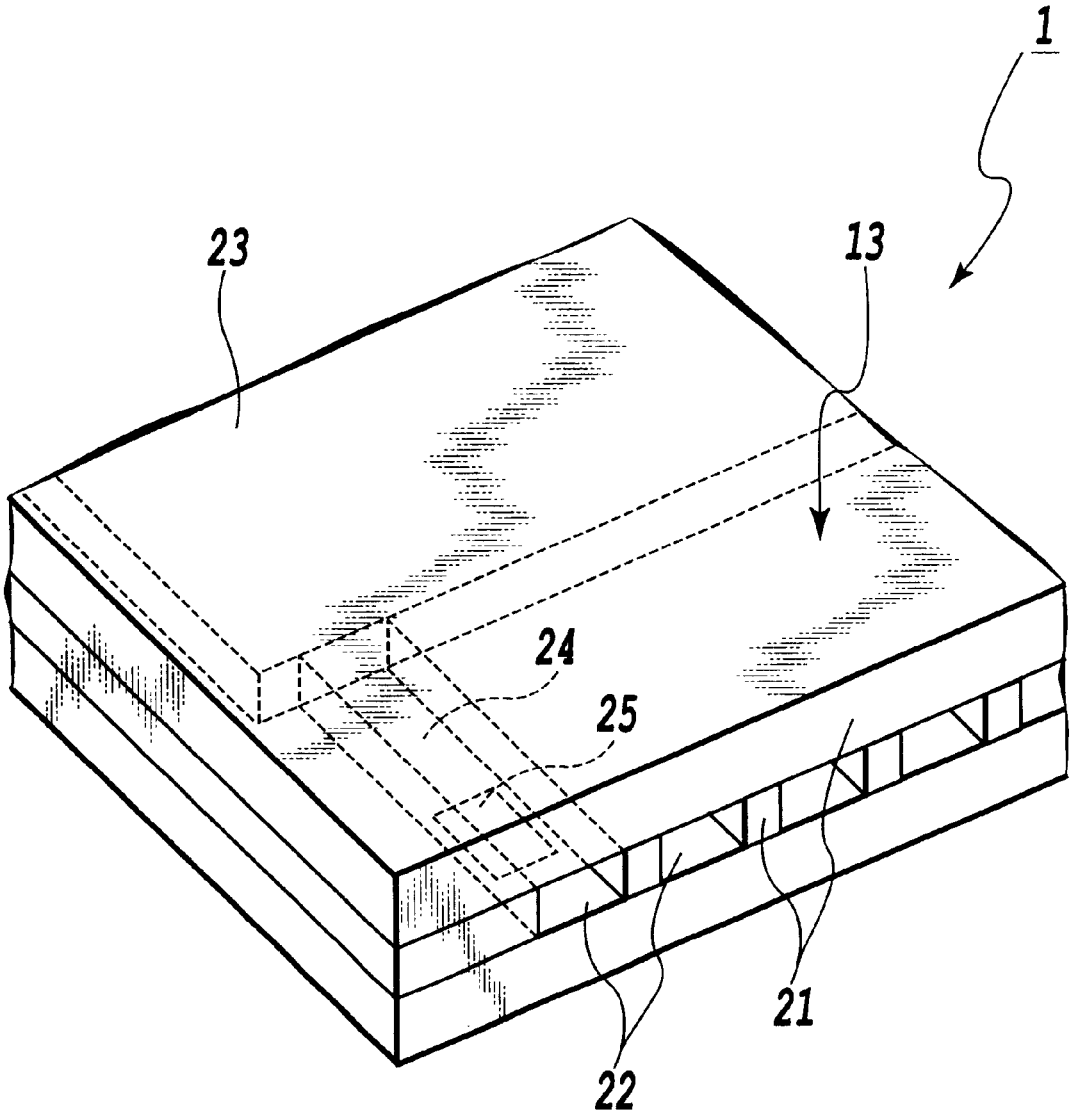
FIG. 2 is a perspective view schematically showing the structure of a main part of a printing head, shown in FIG. 1.

FIG. 2 is a schematic perspective view partly showing the structure of a main part of an ink ejecting part 13 of the printing head 1. an ejection opening surface 21 located opposite the printing material 8 via a predetermined gap (about 0.5 to 2 mm) has a plurality of (in this case, 256) nozzles 22 at a predetermined pitch (in this case, 360 dpi). In each liquid path 24 making corresponding nozzles 22 communicate with a common liquid chamber 23, an electrothermal converter (herein after referred to as "ejection heater") 25 is disposed. In this example, the printing head 1 is mounted on the carriage 2 in a positional relation that nozzles 22 are arranged in a direction crossing the main-scanning direction. The printing head described above ejects inks from the nozzles 22 by the pressure caused when driving the electro-thermal converter 25 in accordance with image signals or ejection signals to cause film boiling in the ink in the liquid path 24.

Figure 3:
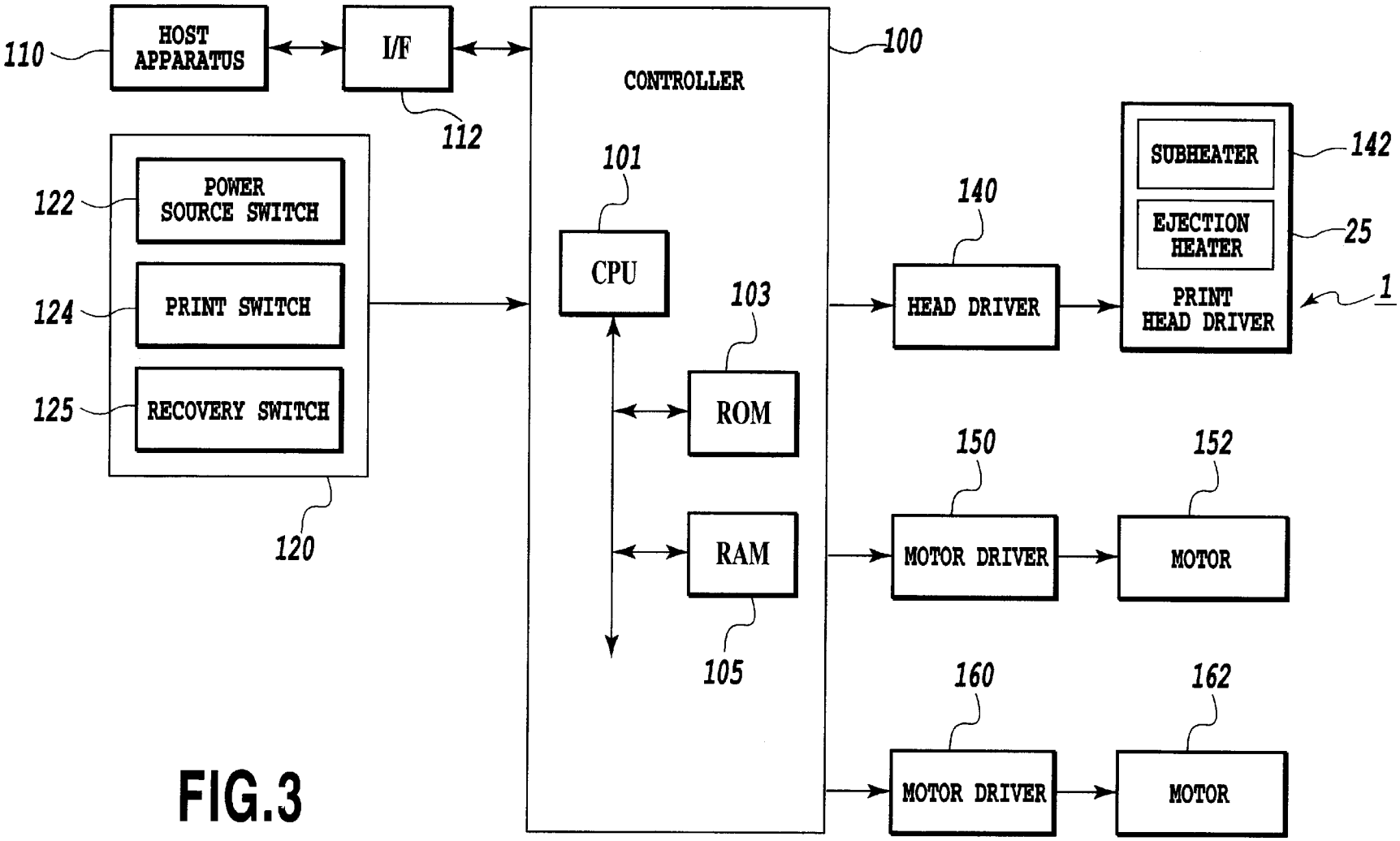
FIG. 3 is a block diagram mainly showing the configuration of a control circuit in the ink jet printing apparatus, shown in FIG. 1.

FIG. 3 is a block diagram schematically showing a configuration of a control circuit in the ink jet printer shown in FIG. 1.

In this figure, a controller 100 is a main control section including a CPU 101 in the form of, for example, a microcomputer, a ROM 103 storing programs, required tables, and other fixed data, and a RAM 105 having areas in which image data is expanded, work areas, and other areas. A host apparatus 110 is a data source that supplies printing data or the like. The host apparatus may be in the form of a computer that creates and processes data such as printing data and executes other processes, or the form of a reader section that reads images or the like. Printing data, commands, status signals, and the like are transmitted to and received from the controller 100 via an interface (I/F) 112.

An operation section 120 comprises a group of switches that receive instructions input by an operator, including a power supply switch 122, a switch 124 used to instruct printing to be started, and a recovery switch 126 used to instruct suction recovery to be activated.

A head driver 140 drives the ejection heaters 25 in the printing head 1 according to ejection data. A head driver 140 has a shift register that aligns printing data with the locations of the ejection heaters 25, a latch circuit that executes latching with appropriate timings, and logic circuit elements that activate the ejection heaters synchronously with drive timing signals, as well as a timing setting section that appropriately sets drive timings (ejection timings) so as to obtain aligned dot formed locations.

The printing head 1 also has sub-heaters 142 provided therein. The sub-heaters 142 are used to adjust temperature in order to stabilize the ejection charateristic of ink, and may be formed on a printing head substrate simultaneously with the ejection heaters 25 and/or may be mounted in the printing head main body or the head cartridge.

A motor driver 150 drives a main-scanning motor 152 so that the motor functions as a power source for moving the carriage 2 (see FIG. 1). A sub-scanning motor 162 is used to transport the printing material 8 (see FIG. 1), and a motor driver 160 drives this motor.

Printing Data Processing

Figure 4:
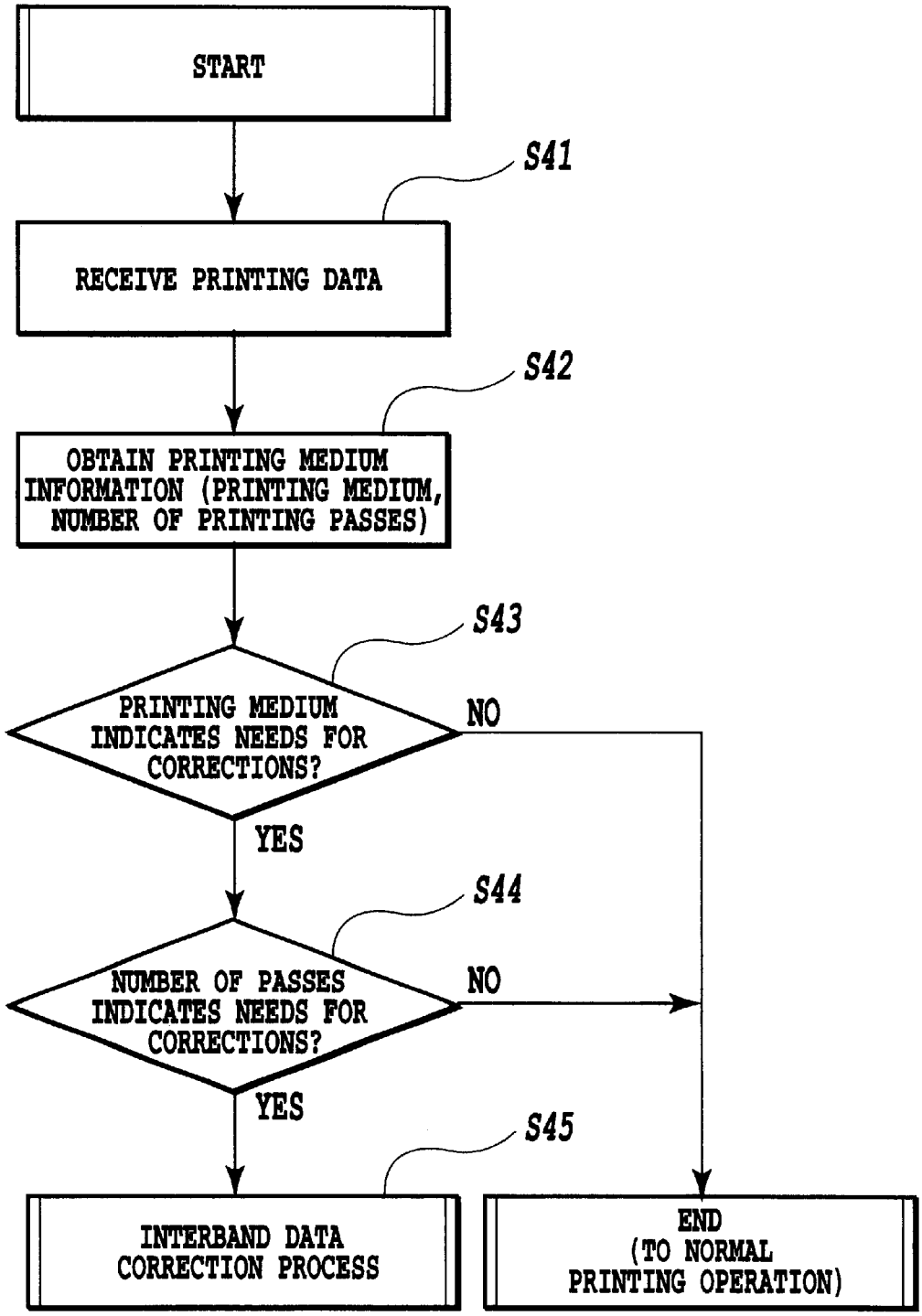
FIG. 4 is a flow chart showing the procedure of a process of determining whether or not to execute an interband data correction process according to a first embodiment of the present invention.

FIG. 4 is a flow chart showing a process of determining whether or not to execute a data correction between bands after reception of printing data, that is, a process of determining whether or not to thin printing data in the vicinity of a joint, according to this example.

This process is activated when the printer receives printing data from the host apparatus 110. At step S41, a series of data reception processes are executed, and at step S42, printing method information added to a leading part (header) of the printing data received at step S41 is analyzed. The printing method information obtained at step S41 is, in this example, a type (a kind) of the printing medium used for printing and the number of printing passes. Since the leading part of printing data is normally added to each page, this process is executed on each page.

At step S43, on the basis of a printing mode table, described later for FIGS. 5A, 5B, it is determined whether or not to execute a data correction process between bands for the printing medium identified at step S42, that is, whether or not to execute the thinning process.

when it is determined that no correction is required, this process is ended to start normal printing, that is, printing without any thinning process. This normal printing is well known, and description thereof is thus omitted.

Figure 7:
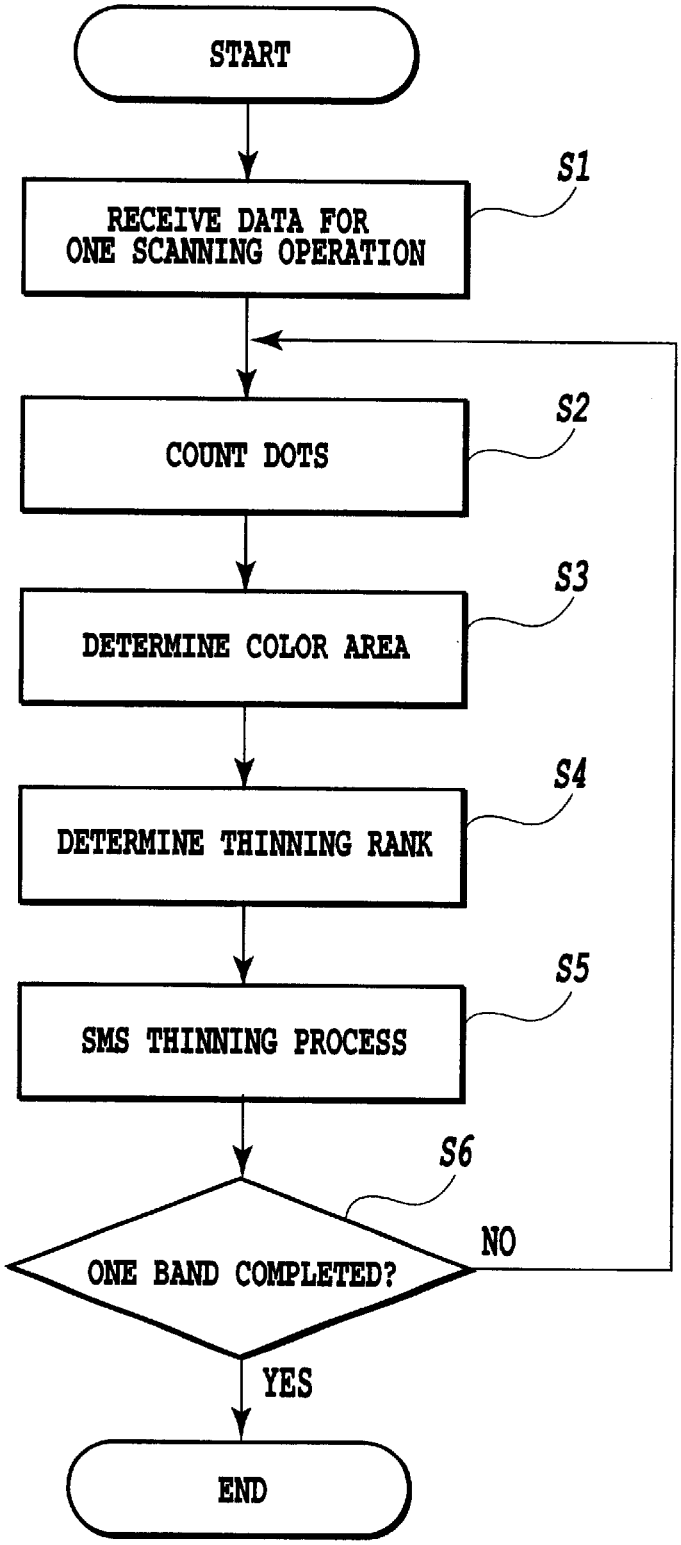
FIG. 7 is a flow chart showing the procedure of a thinning process according to the first embodiment.

When it is determined that the data correction process is required, a similar determination is made for the number of passes at step S44. That is, at step S44, by referencing the printing mode table shown in FIGS. 5A, 5B as in step S43, it is determined whether or not the number of passes determined at step S42 indicates the needs for the data correction process. When it is determined that no correction is required, this process is ended to execute the normal printing. On the other hand, when it is determined that the number of passes indicates the needs for data correction, thinned printing is executed by executing the data correction between the bands at step S45. The details of the thinned printing with the data corrections are shown in FIG. 7 and will be described later. As stated above, this example causes the data correction process between bands when both the type of the printing medium and the number of passes indicate the needs for the data correction.

FIGS. 5A and 5B are views illustrating the contents of the determinations in steps S43 and S44. Specifically, these figures show the contents of a printing method table that stores data indicating whether or not to execute the thinning process depending on the type of the printing medium and the number of passes.

In this example, by referencing the table shown in FIG. 5A or 5B, whether or not the thinning process is to be executed is determined depending on the type of the printing medium and the number of passes required to complete printing each band, both of which constitute the printing method information added to the printing data transmitted from the host apparatus. The printing method information can be selected and set via a printer driver in the host apparatus as a combination of the type of the printing medium and the number of passes corresponding to a print quality.

FIGS. 5A and 5B show two examples of the table, which are selected correspondingly to temperature of an ambiance of the printer. In each of the figures, ON/OFF indicates that the data correction process is executed/is not executed, respectively, by means of the thinning process. It should be noted that in these figures, sections in which ON or OFF is not mentioned are of combinations of the printing medium and the number of passes which are not set in the printer of this example.

For example, the table shown in FIG. 5A indicates that when the printing medium indicated by the printing method information is, for example, an ordinary paper and the number of passes is one, two, or four, the thinning process is executed on printing data in four rasters of a sheet-feeding-side, described above, in the vicinity of a joint. That is, on the ordinary paper, a joint streak is relatively likely to occur specifically in a high temperature and high humidity environment even with a large number of passes, the thinning process is executed for four passes as well as for one or two passes. On the other hand, when the printing method information indicates a coat paper and the similarly indicated number of passes is four or six, the table outputs data indicating that the thinning process is not to be executed. This is because the joint streak is hard to occur on a printing medium such as the coat paper through which ink permeates only to a relatively shallow portion of the surface thereof as described previously, so that a sufficient joint-streak reducing effect is obtained simply by increasing the number of passes up to four or six, thereby eliminating the needs for further thinning process. Further, it is necessary to prevent a white streak that may arise from an excess of thinning process from occurring. This prevents time from being unnecessarily spent on the thinning process and the printing operation.

With the table shown in FIG. 5B, when printing one band with the number of passes being four or more, the thinning process is not executed regardless of the type of the printing medium, whereas in a printing mode with less than four passes, the thinning process is executed. Consequently, whether or not to execute the thinning process can be determined simply by identifying the number of passes. Thus, depending on the setting for the printing mode, whether or not to execute the thinning process can be determined using only the number of passes, thereby reducing the load of the determination process (step S43 in FIG. 4).

The flow of ink from one band to another via a joint is greatly affected by an environment temperature at which the printer is used. Thus, in this example, the table for normal and high temperature environments shown in FIG. 5A and the table for a low temperature environment shown in FIG. 5B may be switched according to temperature which is detected by a temperature sensor built into the printer. The tables may be switched according to humidity of the environment as well as the temperature. Further, in addition to the determination of whether or not to execute the thinning process, the variation of the amount of thinning may be carried out depending on the type of the print medium and the number of passes and taking the dot count into consideration.

FIG. 7 is a flow chart showing the data correction process executed between bands, at Step S45 shown in FIG. 4.

At step S1, printing data is received which is required for the data correction process for printing of one scanning operation corresponding to each ink color. the required printing data includes, in addition to printing data of one band for one scanning operation, printing data of a dot count area in a band to which the subsequent scanning operation is executed. Here, "one band" designates a printing area formed while one scanning operation of the printing head is executed.

For printing data received and obtained as stated above, processes of following steps S2–S5 are executed for each unit area. The unit area is each area of 16 rasters×16 pixels as shown in FIG. 8A. For each unit area, at first, the number of dots are counted at step S2, the color area is determined at step S3, and the thinning rank is determined at step S4. Then, at step S5, printing data for four rasters in the vicinity of the corresponding joint is subjected to the SMS thinning process. At step S6, the above process is sifted in a scanning direction to be repeated until one band is completely processed. The details of each process will be described below.

Definition of Band

Figures 6A, 6B:
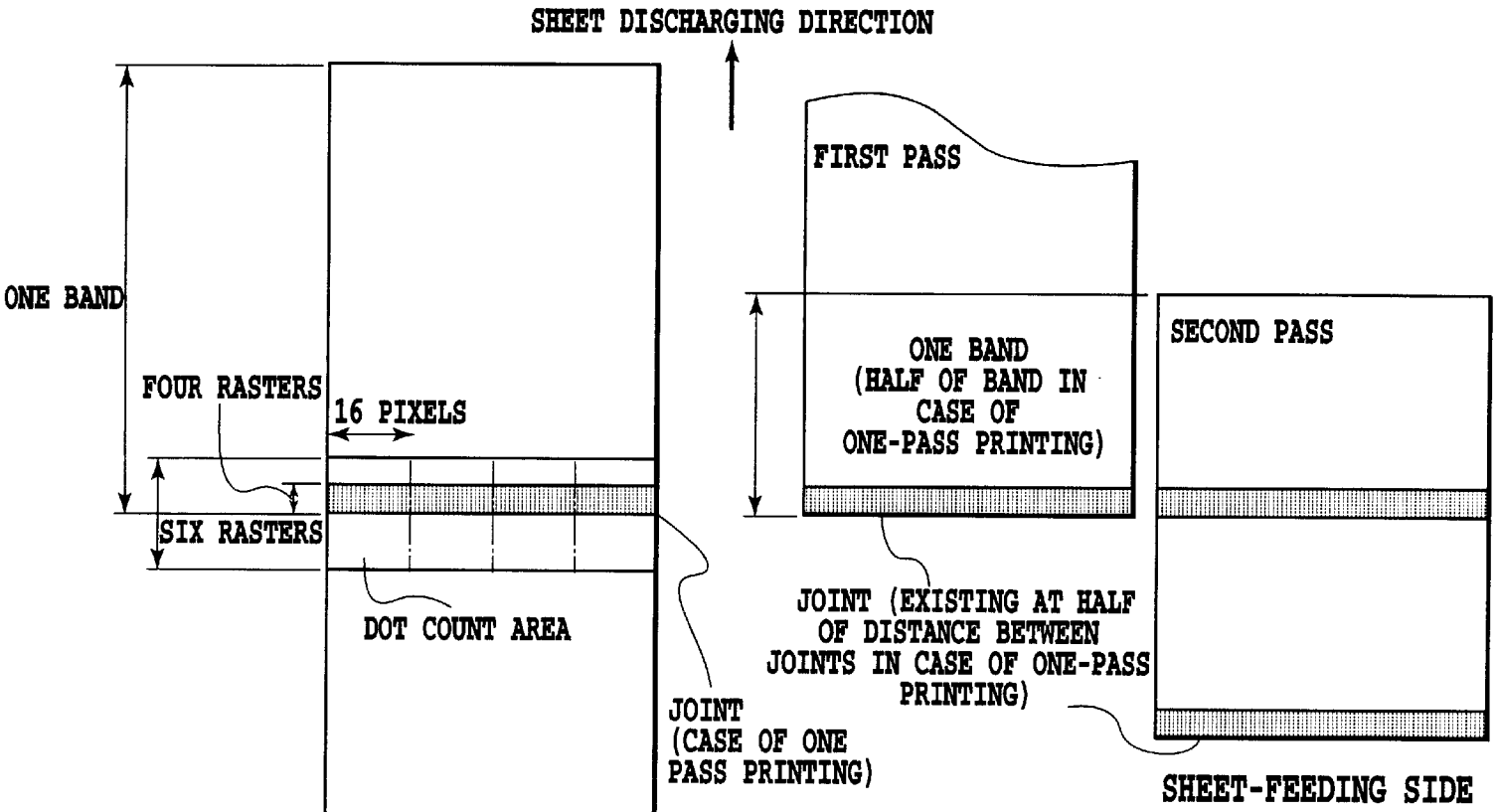
FIGS. 6A and 6B are views illustrating areas in which thinning is carried out in the case of one- and two-pass printing, respectively.

FIGS. 6A and 6B show two examples of the printing method in relation to the number of passes. FIGS. 6A, 6B show the one-pass and two-pass printing processes, respectively, in which joint streaks occur at different locations. A joint streak occur at the boundary between the ink landing during previous scanning operation and the ink landing during subsequent scanning. Then, in the case that the print of the two-pass printing is formed with half an amount of sheet feeding used for the one-pass print, a joint of the two-pass printing, which is also the boundary of inks, is located at half distance in a sheet feeding direction between joints in the one-pass print, as shown in these figures. Thus, the area of one band varies with the number of passes, and the above described band management must be carried out considering the sheet feeding amount.

Dot Count

In this example, an area in which dots are counted has a width of 16 rasters including the joint between bands.

Dot count is performed based on all the inks installed in the printer of this example, that is, based on binary data as ejection data for each of cyan, magenta, and yellow. Within the binary data for all the inks, binary data having "1" indicating ejection of ink is counted to be summed as a dot count value for the result of the dot counting (or a total dot count value).

Here, the dot count value will be described in further detail. When "the dot count value is 1" for one pixel, this means that one dot is printed for this pixel. For a dot count value of 2 for one pixel, two dots are formed for this pixel.

Dots count is performed, as described above, for each unit area having a size of 16 rasters in the sheet-feeding (transporting) direction and 16 pixels in the main-scanning direction of the printing head. Thus, the maximum value of the total dot count value is 16 (rasters)×16 (pixels)×3 (colors)=768.

The process of this example comprises the procedure of determining the thinning rank from the total dot count value obtained by this dot counting and then executing the SMS thinning process. Further, relative information indicative of the relative relationship between the amounts of ink landing on the unit area can be obtained from the dot count value for each color. Then, the color area (hue or both hue and saturation) of the unit area is determined from this relative information.

This process is repeated for all of one band in the scanning direction, and is then executed for all the bands in one page to generate print data.

Accordingly, for example, for 360 dpi and A4 full scan length (which is a scanning length corresponding to a width of A4 size sheet and is about 8 inches), the number of the unit area is 360 (dpi)×8 (inches)÷16=180, and accordingly, 180 times of calculation are required for forming one band.

In this example, the total dot count value is simply the sum of the count values for cyan, magenta and yellow, but the colors may be weighted when they affect the occurrence of the joint streak to different extents. When, for example, the yellow ink serves to cause the joint streak to be more noticeable, the dot count value may be weighted for the dot count value for yellow (for example, the dot count value for yellow is multiplied by 1.2). Further, if the amount of ink ejected varies with the color (for example, a certain color ink is ejected in a larger amount), then of course this condition may be considered.

The above-described dot count process requires only the data processing on the small area in the vicinity of the joint in one band. Consequently, this process is subjected to only a small load, and can properly deal with the case in which only a short time is assigned to this process in order to obtain a high speed as in the one pass printing.

Further, the reason why an area of 16 rasters×16 pixels covering the joint is defined as the unit area for dot counting will be described below.

In this case, the maximum value of the total dot count value is 16×16×3 (colors)=768. To form one band, for printing of 360 dpi, 180 times of calculation are required as descried above. Also, for 600 dpi and A4 full scan length (about 8 inches), the number of the unit area is 600 (dpi) 8 (inches)÷16=300, and then 300 times of calculation are required. Specifically, as shown in FIG. 8A, dots are sequentially counted in each unit area for dot count over all the range of the length setting, and the calculations are completed for all the unit areas, so that the dot counting operation is completed for one band.

By thus setting an area covering the joint as the dot count area, the status of dots to be formed in front and back areas of the joint can be determined. That is, it can be determined whether or not the ink landing on the printing medium is likely to cause the joint streak, thus enabling more accurate joint-streak processing. In contrast, if dots are counted only within one band, the amount of bleeding, which may be cause of the joint streak in this area, can be estimated, but the adverse effects of the bleeding to adjacent band cannot be determined. The occurrence of the joint streak varies depending on the amount of ink in the vicinity of the joint between the bands. For example, when there is an adequate amount of ink landing on the next scanned band, the joint streak is likely to occur due to the bleeding of ink from both bands. However, when there is a smaller amount of ink landing on the next scanned band, though it is possible that the bleeding of ink in the first scanned band, the bleeding is unlikely to become the joint streak.

Figure 16A:
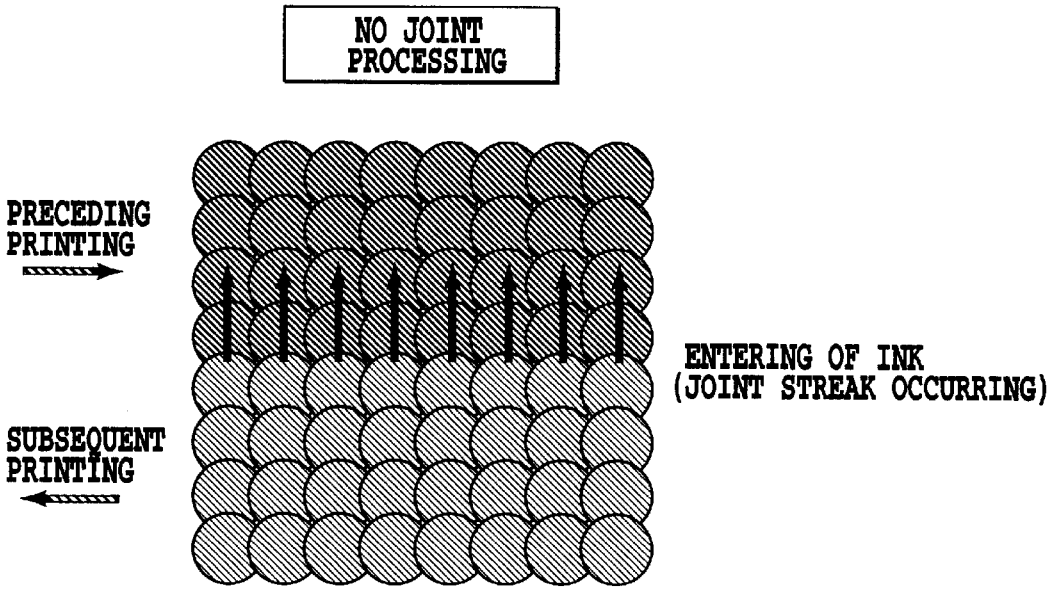
FIGS. 16A and 16B are views illustrating the principle of the occurrence of a streak on a joint between bands or the vicinity of the joint.

The detail mechanism of the occurrence of the joint streak will be described with reference to FIGS. 16A and 16B.

When fixing of the ink in the first scanned band is promoted in a condition of causing slight bleeding, printing for the adjacent second scanned band is performed. In this printing, it can be assumed that while the ink in the adjacent band is permeating through the interior or surface of the paper, the ink in the adjacent band is drawn to the first scanned band. At this time, in the case that printing data of vicinity of the joint has not been subject to any process, the amount of ink flowing through the joint between the bands increases as shown in FIG. 16A, thereby increasing the density of the vicinity of the joint and the joint streak occurs.

Figure 16B:
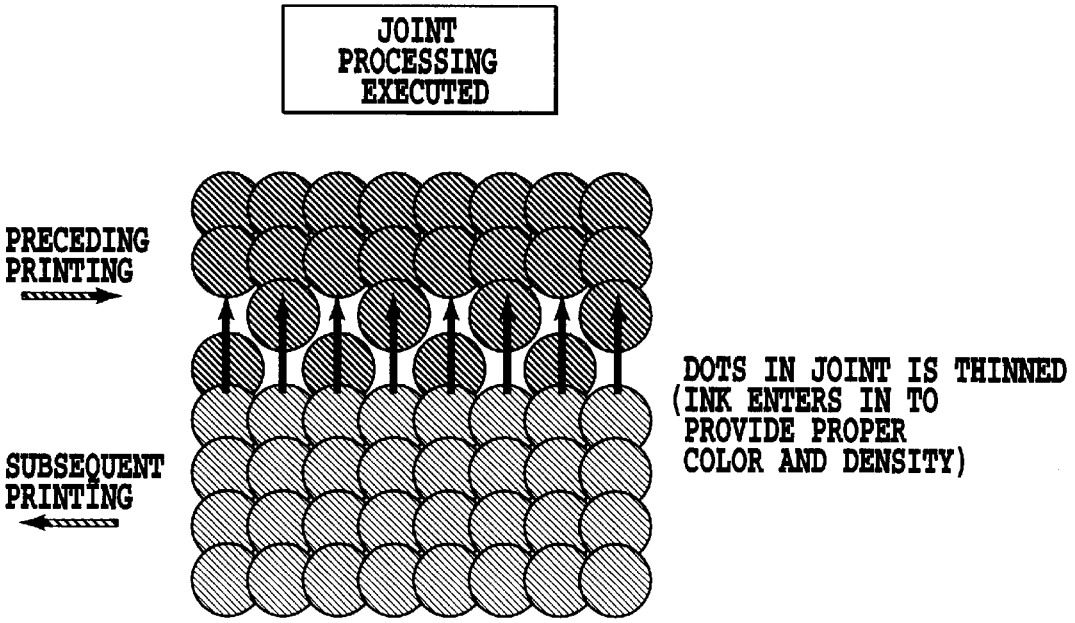

Accordingly, in order to restrain the occurrence of such joint streaks, it is effective that process of thinning dot is executed to reduce the amount of ink present at least one of bands adjacent to each other, as shown in FIG. 16B.

As described above, the joint streak occurs depending on the amount of ink landing on both the bands each joined to the joint. Accordingly, by setting an area covering the joint as the unit are for dot count, the efficiency of the joint streak processing can be improved to achieve effective joint processing.

Further, when counting dots for the bands each joined to the joint, the counting may be weighted in different between the previous scanned band and the subsequent scanned band. For example, if the joint streak tend to occur due to the amount of ink in the previous scanned band, multiplying the dot count value for this band by 1.2 so that control sensitively cope with the amount of ink in the previous scanned band can be performed.

Determination of Color Area

Figure 10:
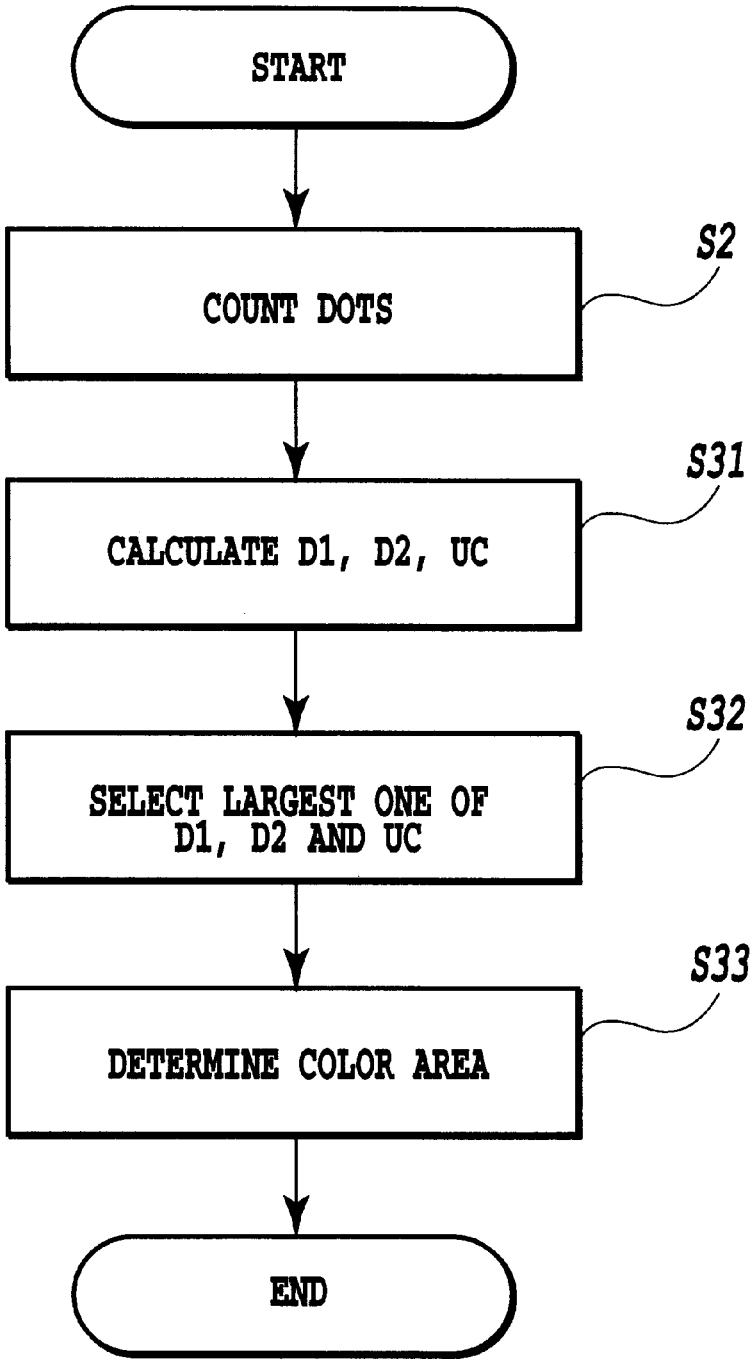
FIG. 10 is a flow chart showing the procedure of determining a color area according to the first embodiment.

Next, determination process of the color area of step S3 shown in FIG. 7 will be described based on a flow chart shown in FIG. 10.

Figure 11:
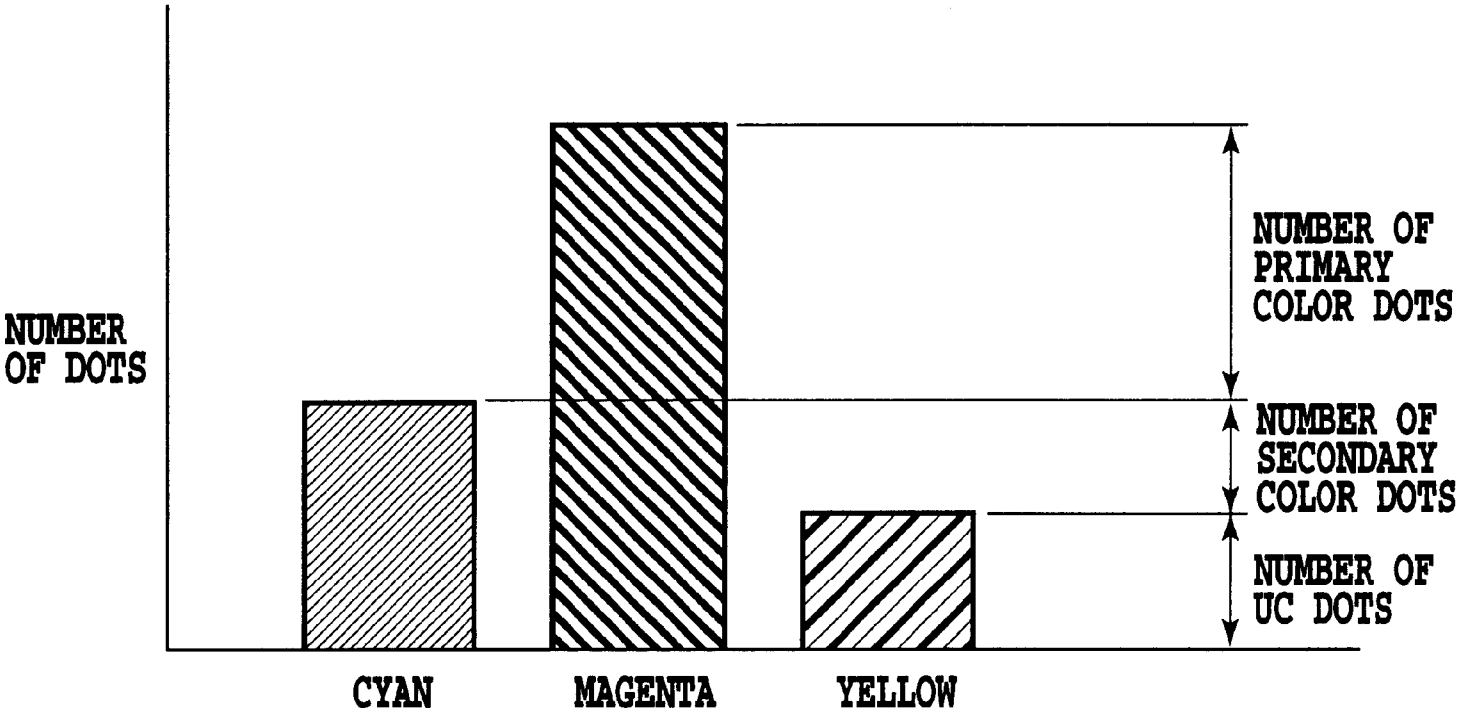
FIG. 11 is a schematic view showing an example of a dot count value for a certain unit area according to the first embodiment.

First, as described for step S2 of FIG. 7, the dot count for each ink color is performed. FIG. 11 shows an example of dot count values for a certain unit area, and FIG. 12 shows divided sections of color areas used for this example.

In the example shown in FIG. 11, the number of dots is large in the order of magenta, cyan and yellow. In this case, the yellow portion, which has the smallest number of dots among cyan, magenta and yellow, is generally called a "UC" (Under Color). A part of cyan, having the second largest number of dots, minus UC corresponds to secondary color (also represented as D2; in this example, blue). A part of magenta, having the largest number of dots, minus cyan, having the second largest number of dots corresponds to primary color (also represented as D1; in this example, magenta). The D1, D2 and UC are calculated at step S31.

Figure 12:
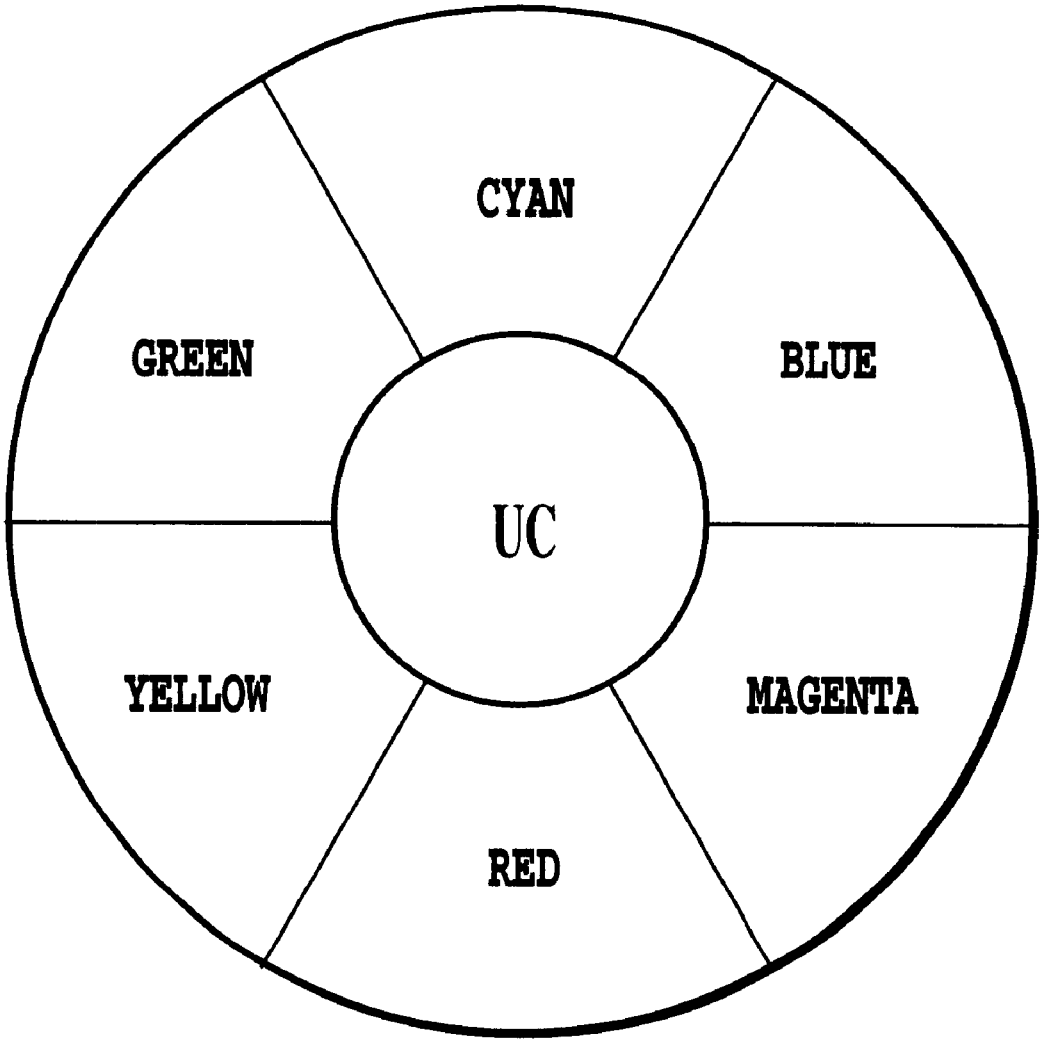
FIG. 12 is a view showing an example of division of color areas according to the first embodiment.

By determining one of D1, D2 and UC which has the largest value (step S32), it is determined which of the color areas shown in FIG. 12 corresponds to the unit area subjected to the processing (step S33). In this example, D1 has the largest value, it is determined that the dot count area is within magenta.

If two or three of D1, D2 and UC have the same largest value, a color area will be selected in the order of UC, D2 and D1 (UC is selected if UC and D2 have the same value, the D2 is selected if D1 and D2 have the same value, and D1 is actually not used).

Thinning Rank Graph

After above-described determination process of the color area, determination process of the tinning rank is executed at step S4 shown in FIG. 7. FIGS. 13A and 13B show two examples of the thinning rank graph used to determine the thinning rank.

In FIGS. 13A and 13B, the axis of ordinates indicates the thinning rank (corresponding to the thinning rate), while the axis of abscissas indicates the total dot count value. That is, the data thinning rate (a count value in SMS) is obtained from the total dot count value for a unit area obtained by the dot counting process described above.

In this example, the thinning rank is set at nine levels of 0–8 as the thinning rate: 0%, 12.5%, 25%, 37.5%, 50%, 62.5%, 75%, 87.5% and 100%. FIG. 14 shows an example of the dot count values corresponding these nine levels.

Further, in this example, the thinning rank graph is specified using a combination of the three numerical values including the start dot number, the dot interval, and the MAX rank, as described previously. FIGS. 13A and 13B show how these three parameters correspond to the components of the thinning rank graph.

In this example, the thinning rank graph is specified using the three parameters (the start dot number, the dot interval, and the MAX rank) as described above, but of course the present invention is not limited to this configuration. For example, when the thinning rank graph is specified as in this example, the relationship between the total dot count and the thinning rate must be linear. However, a non-linear relationship may be established by specifying the form of the thinning rank graph. Further, the thinning rate need not be limited to the nine levels listed above, but the number of the levels of the thinning rate may be increased or reduced as required.

FIGS. 15A–15F show thinning rank graphs actually used in this example. As described above, the thinning rank graph is set for each color area, in a manner described later in referring to FIGS. 22, 23 for Second example. FIGS. 15A–15E show the case of magenta determined based on color areas shown in FIG. 12.

Figure 8B:
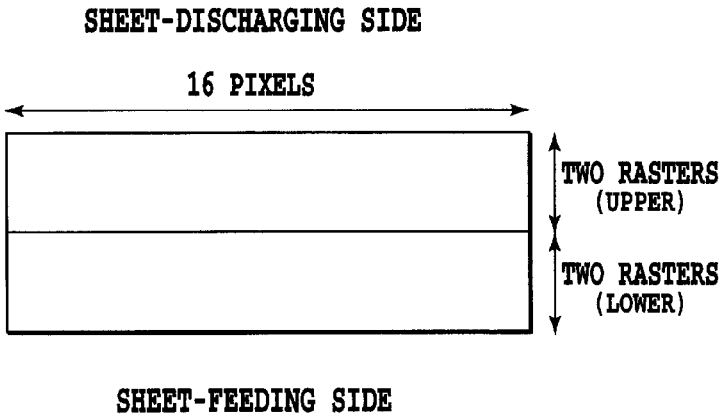

Then, the thinning rank is specified for each of inks (cyan, magenta, and yellow) used for printing area that is determined as the color area of magenta. More specifically, for each ink color, the 4 rasters of the thinning area is divided into two areas: upper and lower areas in sub-scanning direction as shown in FIG. 8B. Then, the thinning graph is specified for respective upper and lower areas. Accordingly, as shown in FIGS. 15A–15E, for the color area of magenta, six thinning rank graphs (cyan ink upper, cyan ink lower, magenta ink upper, magenta ink lower, yellow ink upper and yellow ink lower) are specified.

Further, this printer allows different numbers of passes to be used for printing according to settings provided by the user even if the same printing medium is used.

Figure 15A:
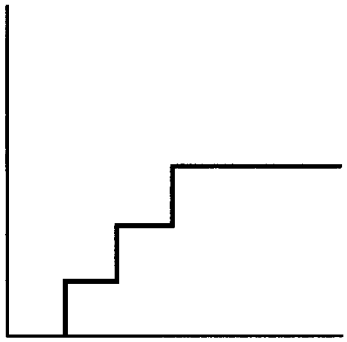
FIGS. 15A–15L are views showing examples of the thinning rank graphs according to the first embodiment.
Figure 15B:
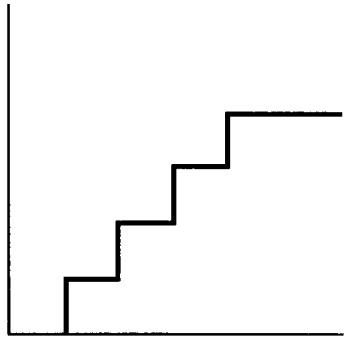
Figure 15C:
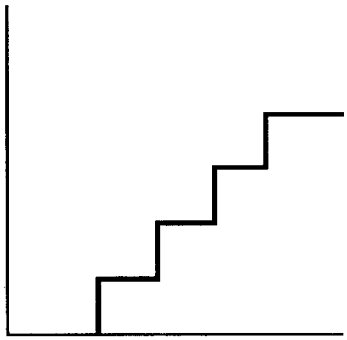
Figure 15D:
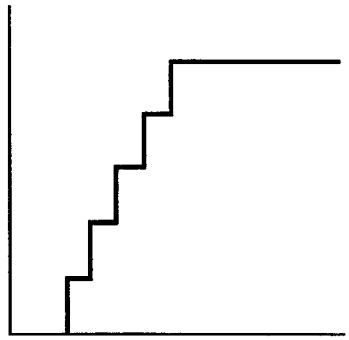
Figure 15E:
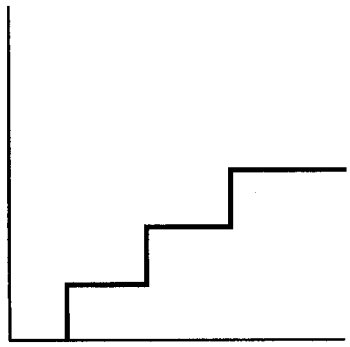
Figure 15F:
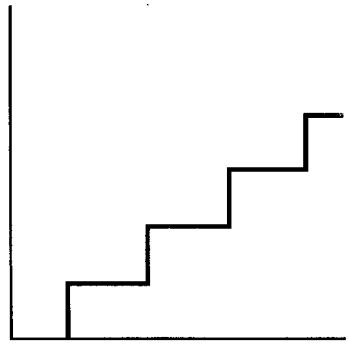
Figure 15G:
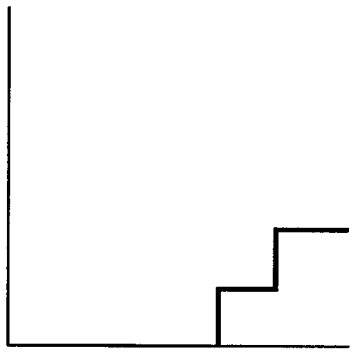
Figure 15H:
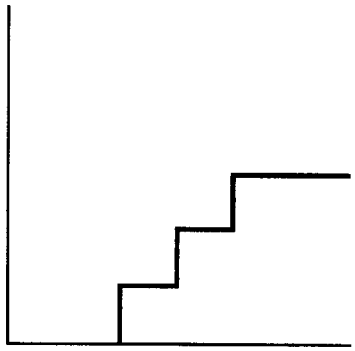
Figure 15I:
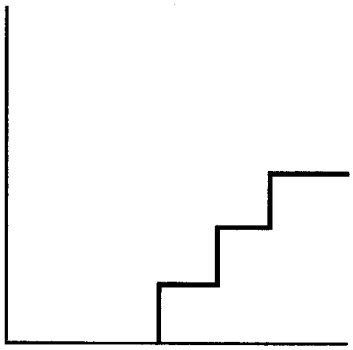
Figure 15J:
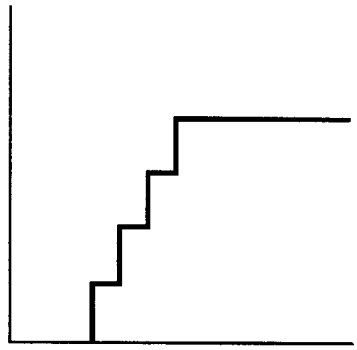
Figure 15K:
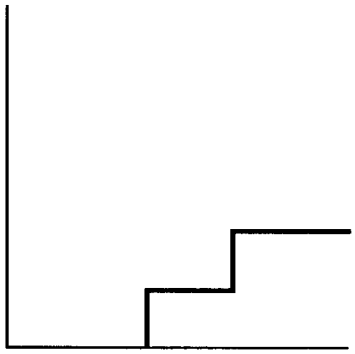
Figure 15L:
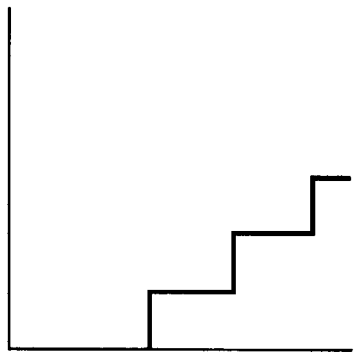

For example, FIGS. 15A and 15B show thinning rank graphs of cyan ink used for the one-pass printing in the case that the color area is determined as magenta. Similarly, FIGS. 15C and 15D show thinning rank graphs of magenta ink used for the one-pass printing and FIGS. 15E and 15F show thinning rank graphs of yellow ink used for the one-pass printing. When hue is determined to be contained in the color area of magenta, the hue is represented with cyan, magenta and yellow, which are combined at respective rate and printing of the hue is executed by using these three color inks. Therefore, the thinning rank is determined for respective ink colors by using the thinning graphs shown in FIGS. 15A–15F. It should be noted that the two-pass printing undergoes a smaller amount of the joint streak than the one-pass printing and generally tends to require a lower level of thinning. Accordingly, it is desirable that the thinning rank is differentiated depending on the number of printing passes, in addition to the type of the printing medium and the color area. Therefore, in this example, the thinning ranks are independently specified correspondingly to the number of passes also.

More specifically, in this example, the thinning rank graphs are provided for two-pass printing independently of that for the one-pass printing. The larger the number of scanning operations to complete printing of a predetermined area is, the smaller the number of dots formed during one scanning operation is. Accordingly, in the case of large number of passes required for printing, it is preferable to reduce the thinning amount. Thus, as shown in FIGS. 15G–15L, thinning level for two-pass printing is made lower than that of one-pass printing shown in FIGS. 15A–15F.

Above stated graphs of FIGS. 15A–15F are related to the graphs for the color area of magenta, but this combination can also be set for respective color areas of magenta, yellow, UC, blue, red and green.

The thinning rank graphs are specified for each color area of an area to be printed and for each ink used for printing, as described above. Thereby, printing can cope with differences in the extent of the joint streak associated with the use of the different inks, that is, differences in the behavior of the ink on the printing medium or differences in the manner streak appear, which result from differences in lightness or saturation between the different inks.

Furthermore, since the thinning rank graph can be specified for each ink color, this example can cope with a change in color at the end of the band occurring depending on the order of the inks in landing on the print medium.

The change in color at the end of the band refers, as described in referring to FIG. 26B, that in the case that the inks behave differently owing to a time difference in landing on the printing medium between the inks or the nature of the print medium but the time difference is very small as in the horizontal printing head according to this example, and, for example, the cyan ink and then the magenta ink are ejected to the same position of ordinary paper, something like an outline of the magenta ink, ejected later, is formed on the printing medium. When the color thus changes at the end of the band, the extent of the streak at a joint part can be reduced by varying the thinning rate for each ink color, that is, by increasing the level of the thinning rate for magenta above that for cyan in the landing order that the cyan ink and then the magenta ink are ejected, a state of the joint streak can be improved.

Thinning Process Area

In this example, as described above with reference to FIG. 8A, an area of four rasters in the sheet-feeding-side band and 16 pixels in the main-scanning direction is subjected to thinning process. In addition, the processed four rasters are divided into two areas each composed of two sheet-discharging-side rasters (also referred to as "upper") or two sheet-feeding-side rasters (also referred to as "lower"). Then, the thinning rank graph is specified for each of the thinning rank for each of these areas, respectively.

As apparent from FIG. 8A, the thinning area and the dot count area in this example are not identical, but the dot count area partly constitutes the thinning area. In this manner, the thinning area and the dot count area need not be equal.

This is because it is assumed that the occurrence of joint streaks is not such a simple phenomenon as occurs only at the vicinity of the joint but that the ink bleeding between bands or the ink bleeding from a location several rasters apart from the joint propagates in a chain-reaction-manner depending on how the dots are connected together. For example, different joint streaks occur between the case in which inks land on only four rasters of the vicinity of the joint and the case in which inks land on part of eight rasters from the joint. The latter case involves a larger extent of the joint streaks. This is because the ink bleeding from a location several rasters from the joint gradually propagates toward the joint to relatively increase the amount of ink therein, so that the joint streak become likely to occur therein. Accordingly, the dot count area is desirably set to be larger than the thinning area by taking the chain-reaction-like propagation of the bleeding ink into consideration. In this example, the dot count area is set to be double the thinning area.

Further, the thinning area must be large enough to effectively execute the joint streak processing. However, when the thinning area is extremely large, the thinning may contribute to reducing the density depending on the level of this process, thus inducing white streaks. An appropriate width of the thinning area is determined on the basis of these factors and ink characteristics. In this example, the thinning area has a width equal to four rasters (a width of about 0.17 mm at 600 dpi), which is effective in restraining the joint streaks while preventing white streaks from occurring.

In this example, four rasters are provided as a thinning process area that is divided into two sections, but it should be appreciated that this area may be divided into four so that the thinning rank graph can be specified for each of the four rasters.

By thus further dividing the thinning area so that the thinning table can be specified for each of the smaller sections, more appropriate thinning rates and areas can be set depending on the intensity of streaks.

As described above, it is assumed that the occurrence of joint streaks is not such a simple phenomenon as occurs only at the vicinity of the joint but that joint streaks occur when the ink bleeding from a location several rasters apart from the joint propagates in a chain-reaction-manner depending on how the dots are connected together. Accordingly, when the mechanism of the ink bleeding is considered, it is presumably more effective to process not only the vicinity of the joint but the portion apart from the joint. It should be appreciated that one or two rasters in the vicinity of the joint are the greatest cause of the joint streaks. Furthermore, the effects on the joint streaks vary with an increase in the distance from the above one or two rasters; the effects become different in the order of an area located one raster apart therefrom, an area located two rasters apart therefrom, and an area located three rasters apart therefrom. In the vicinity of the joint, the raster in a certain area is a cause of the joint streaks, but the rasters produce different levels of effects.

Thus, as described above, it is preferable to divide the thinning area into smaller sections each consisting of one or two rasters, determining the thinning rank for each of the smaller sections, and executing a suitable thinning process for each raster. Furthermore, by determining the thinning rank on the basis of the distance from the joint, the joint streak processing can be executed more accurately to provide a more proper amount of thinning for each raster, resulting in more accurate joint streak processing.

SMS Thinning Process

Next, a SMS thinning process at step S7 shown in FIG. 7 will be described. The SMS thinning process is sequentially executed pixel by pixel in the unit area. For each pixel, when the pixel has ejection data "1", which represents ejecting ink, the count value (a particular bit; in this example, the MSB) designated by the counter (register) is read. Then, in the case that the read count value is "1", the ejection data of that pixel is set as data "1" as it is, while in the case that the read count value is "0", the ejection data "1" of that pixel made changed into data "0" so that the ejection data is thinned. Then, the counter is shifted to the next position on the right. Once the counter reaches its rightmost position, it returns to its leftmost position. The above-described process is repeated each time the pixel has the ejection data "1", which represents ejecting ink, thus progressively thinned pixels are set.

The SMS thinning process will be described in further detail with reference to FIGS. 17A–17D and FIGS. 18A–18F.

In FIGS. 17A–17D and FIGS. 18A–18F, ejection data representing ejecting ink is denoted by a circle, whereas ejection data representing not ejection ink, that is, the ejection data being of "0", is denoted by a cross. Object data of processing is denoted by a thick line. The counter value is "1" when printing is to be executed, whereas it is "0" when the printing data is to be thinned. The counter value designated by the counter is denoted by a thick line.

In FIG. 17A, the first printing (ejection) data is denoted by a circle and the counter value is zero, so that the first data is thinned. Thus, after the processing, the first data is denoted by a cross, and the counter shifts to the next position on the right (FIG. 17B). The next data is not to be printed and thus remains denoted by a cross, and the counter also remains at the same position (FIG. 17C). For the third printing data, since the counter has not shifted and then a counter value remains to be of one, the printing data remains as it is, while the counter shifts to the next position on the right. In this manner, the printing data is thinned every four printing data (FIG. 17D).

Further, for the thinning process area consisting of four rasters, FIGS. 18A–18F illustrate data obtained before and after the thinning process executed, in the case that an area consisting of eight dots in the main-scanning direction and four rasters in the sub-scanning direction (the area obtained by dividing the thinning process area according to this example into to be half in the main scanning direction for simplicity of illustration) is set to have the thinning ranks "2" on the sheet-discharging side and "4" on the sheet-feeding side.

For simple explanation, the rasters are called a first raster, a second raster, a third raster and a fourth raster from sheet-discharging side to sheet-feeding side, as in FIG. 18A.

The SMS thinning process is executed for each raster starting with the one on the sheet-discharging side; once one raster has been processed, the process shifts to the next raster. In this example, the SMS counter does not return to its initial position even if the thinning rank is changed. Further, in this example, the SMS counter does not return to its initial position even if the thinning process area shifts to an adjacent area within one band; the counter position is fixed within one band. Moreover, when the process shifts to a different band, the counter position returns to its initial position.

Further, the initial position of the counter in a starting process area within one band is randomly designated. As a result, the first to fourth rasters are processed as shown in FIGS. 18B to 18E, and the resultant rasters are all shown in FIG. 18F.

According to the joint streak correction by First example, which has been described above, the color area of an object area of processing is determined based on the number of printing data (the number of dots to be formed) in the vicinity of the joint and the thinning rank can be set for each ink color correspondingly to the determined color area. By executing the thinning process for each ink color with the thus set thinning ranks, the extent of the joint streak that may occur between the bands can be reduced.

Second Example

Like the first example, a second concrete embodiment of the present invention relates to a printing method of performing printing by ejection ink on a printing medium from a plurality of printing heads.

The construction of the ink jet printer used for this example as well as the thinning process area and the SMS thinning process also used for this example are all the same as those in the first example.

Dot Count

The dot count unit area in this example is similar to that in the first example.

Figure 19A:
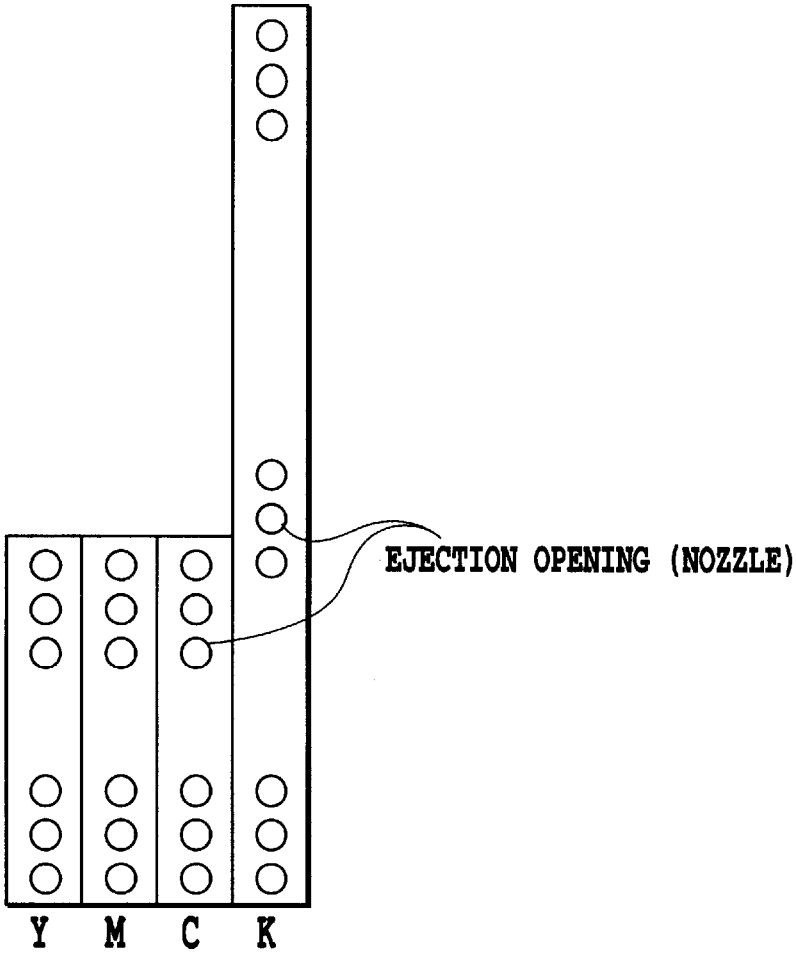
FIGS. 19A–19C are schematic views showing the construction of a printing head used in a second embodiment of the present invention.

The construction of the printing head used for this example is shown in FIG. 19A.

In this construction, the number of black ink nozzles is double the number of color ink nozzles and when data consisting of only black is to be printed, for example, only text data such as characters is to be printed, all the black nozzles are used to increase the printing speed. Further, when data consisting of a mixture of black and other colors is to be printed, a reduced number of black ink nozzles are used with color ink nozzles to form an interval between the black ink ejection and the color inks ejection for at least one scanning operation, so as to prevent the bleeding of ink from occurring.

Figure 19B:
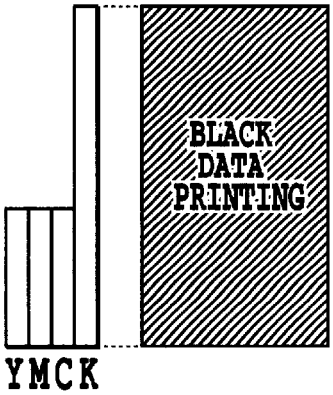
Figure 19C:
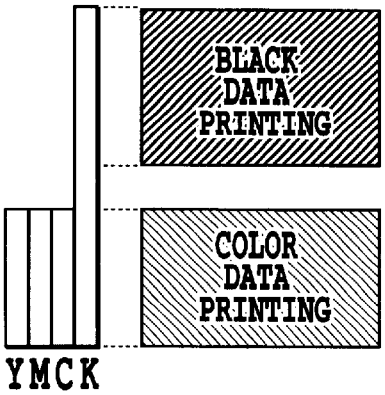

FIG. 19B is a schematic view showing how black-only data is printed on the basis of the above construction. FIG. 19C shows how black and color mixed data is to be printed.

Joint streaks are likely to occur when a color image or the like is printed, which requires a large amount of ink to be ejected onto the printing medium. In this case, the black ink is ejected before the color inks, and when the ejection of the color inks is started, a required amount of black ink has been totally ejected and fixed to the printing medium, therefore the black ink gives small effect on the joint streak.

Thus, in this example, the joint processing is executed by counting dots for only the color inks (cyan, magenta and yellow) and without counting dots for the black ink.

Determination of Color Area

FIG. 20 shows sections of the respective color areas in this example. An example of a method of determining the color area will be described below for the color areas show in this figure.

First, a method of determining a hue will be described. Here, the hue is designated by the position of a color on an outermost circumference in FIG. 20, that is, indicates color of primary (cyan, magenta, yellow), secondary (blue, green, red) colors or intermediate between these colors.

Figure 21A:
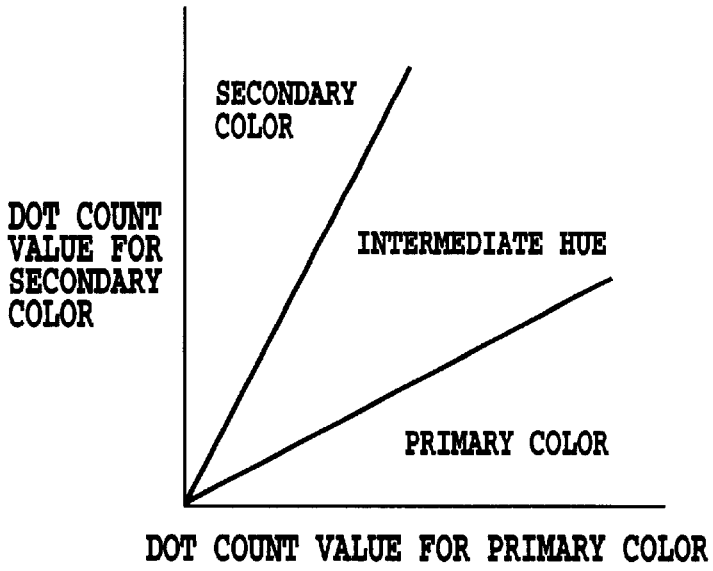
FIGS. 21A and 21B are views illustrating an example of a method of dividing the color area according to the second embodiment.

FIG. 21A is a diagram illustrating as to how the primary, the secondary and the intermediate colors are determined. In this figure, the axis of abscissas indicates the dot count value for the primary color, and the axis of ordinates indicates the dot count value for the secondary color (the sum of dot count values of two primary colors). As shown in this figure, a manner of determining which sections of the primary color, the secondary color or the intermediate color the hue belongs to, according to the dot count value is as follows. The dot count value for the primary color divided by two is compared with the dot count value for the secondary color, and when the former is larger than the latter, the hue is determined to be the primary color.

On the other hand, the dot count value for the primary color is compared with the dot count value for the secondary color divided by two, and when the latter is larger than the former, the hue is determined to be the secondary color. Otherwise the hue is determined to be the intermediate color.

Next, saturation is determined. More specifically, saturation is determined according to how the position is close to the center section of the circle shown in FIG. 20 or to the circumference section thereof or is the section between the center and the circumference thereof.

Figure 21B:
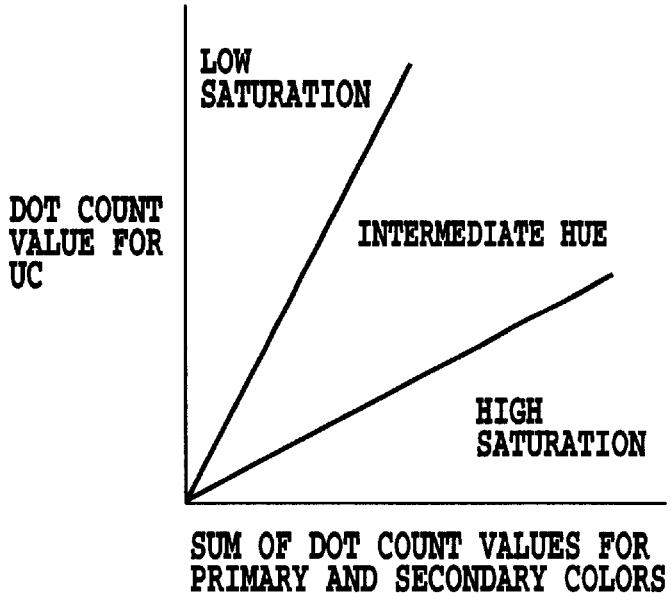

FIG. 21B, in which the axis of abscissas indicates the sum of the dot count values for the primary and secondary colors, and the axis of ordinates indicates the dot count value for UC, is a diagram illustrating a manner of determining of the high saturation, the low saturation, or the intermediate saturation. As shown in this figure, the sum of the dot count values for the primary and secondary values divided by two is compared with the UC dot count value, and when the former is larger than the latter, it is determined that the saturation is located closest to the circumference section, and this area can be determined as the color area of the high saturation.

On the other hand, when the result of a comparison of the UC dot count value divided by two with the sum of the dot count values for the primary and secondary values shows that the former is larger than the latter, it is determined that the saturation is located closest to the center section, that is, is of the low saturation. The remaining area is determined as an area intermediate saturation.

The method of determining the hue and the saturation will be more simply expressed below.

Hue

If D1/2>D2, then hue is of the primary color,

If D2/2>D1, then hue is of the secondary color, and

Otherwise, hue is of the intermediate color.

Saturation

If (D1+D2)/2>UC, then saturation is of the high saturation (closer to the circumference section), If UC>(D1+D2)/2, then saturation is of the low saturation (closer to the center section), and Otherwise, saturation is of the intermediate saturation.

By thus using the color areas divided into the smaller areas, this example can more easily deal with differences in the extent of the joint streaks and with differences in the behavior of the joint streaks for each ink color used.

Thinning Rank Graph

FIGS. 22A–22F show examples of the thinning rank graphs used for this example. The examples shown in figure show the thinning rank graphs of blue shown in FIG. 20 and similarly to First Example, are provided with upper and lower rank graphs for each of three inks used for printing.

In this example, for seven (cyan, magenta, yellow, blue, green, red, and CU) of the color areas shown in FIG. 20, the thinning rank is specified for each of the inks used, and thinning rank graphs for the intermediate areas are calculated on the basis of the ranks for the seven areas. This reduces the amount of data for the rank graphs.

For example, the calculation of the thinning rank graph is executed as follows. For the intermediate area of the hue, the thinning ranks of both the primary color (one of cyan, magenta or yellow) and the secondary color (one of blue, green or red), which are the hue of both side of that intermediate area, are obtained, and a mean of the obtained thinning ranks of the both side hue is calculated to be determined as a thinning rank of that intermediate hue. Similarly, for the intermediate area of the saturation, saturation of this area is determined so that higher thinning rank is selected between the thinning ranks of both the high and the low (UC) saturation. Further, for the thinning rank of an intermediate area in which both hue and saturation are intermediate, for example, at first, the thinning ranks of respective intermediate color areas for saturation of both the primary and the secondary colors are obtained, and then a mean of the thinning ranks of these color areas is calculated to be determined as the thinning rank of the color area in which both hue and saturation are intermediate.

Apparent from above description, since the thinning rank is determined for each ink (cyan, magenta and yellow) and the thinning area is divided into two, the number of thinning rank graphs becomes 7 (color areas)×3 (inks)×2 (areas into which the thinning area is divided)=42.

When, for example, the result of the color area determination indicates that the object unit area is blue, those of the 42 thinning rank graphs which are for the blue color area are actually used. This is shown in FIGS. 22A–22F. Likewise, the thinning rank graphs for the red color area are shown in FIGS. 23A–23F.

When the thinning rank used for the SMS thinning process is thus determined, the determined thinning rank graphs are referred with the total dot count so that the thinning rank used for the SMS thinning process is determined.

In this manner, the amount of data required can be reduced by specifying basic graphs and calculating graphs for the intermediate areas instead of specifying thinning rank graphs for all the color areas obtained by the division.

Once the rank has been determined, the SMS thinning is executed on the unit area as in First Example. After this process has been executed for one band, one scanning operation is performed for printing.

Here, a thinning process in the case of printing color changing from white through blue to UC as described previously will be described with reference to FIGS. 22A–22F.

Figure 22A:
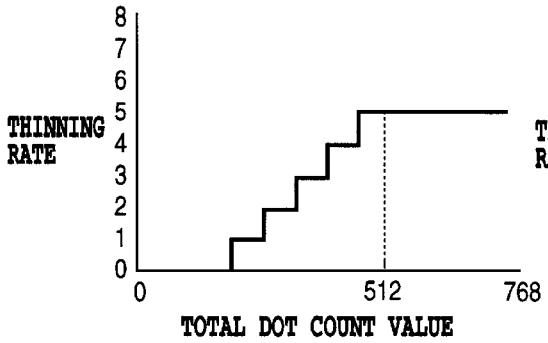
FIGS. 22A–22F are views showing examples of thinning rank graphs according to the second embodiment.
Figure 22B:
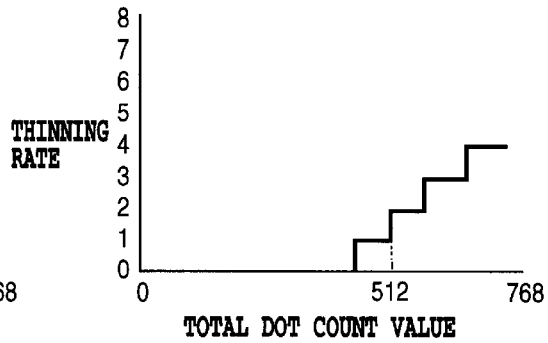
Figure 22C:
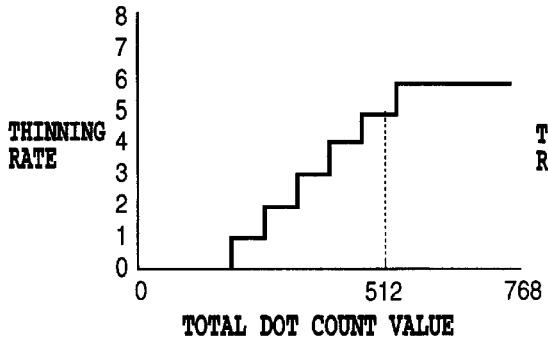
Figure 22D:
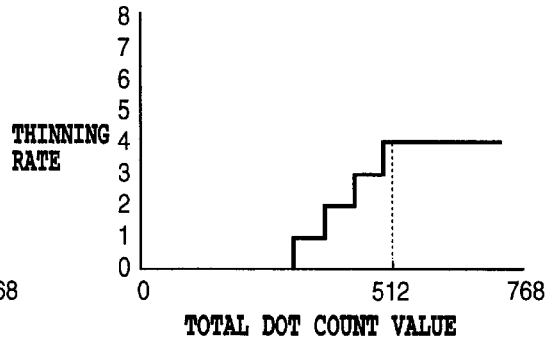
Figure 22E:
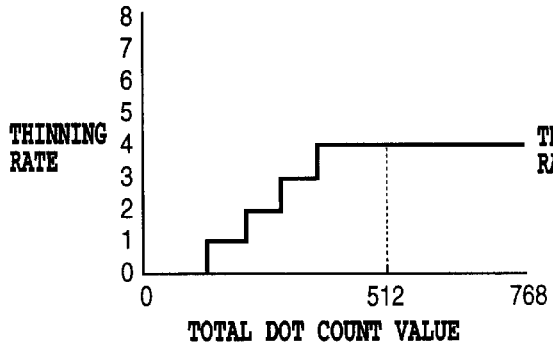
Figure 22F:
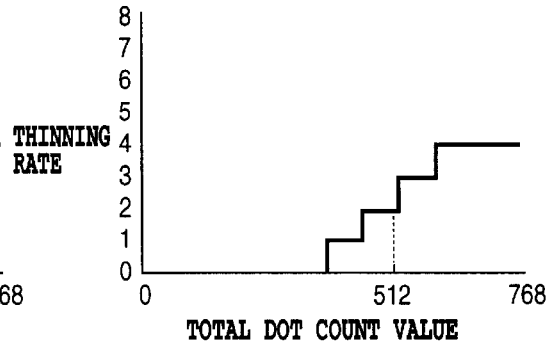

The cyan ink and magenta ink are used for printing before the color turns to blue, and in the case of printing the color of a maximum saturation or maximum gradation of blue, data of the cyan and magenta become data for solid printing (data of respective maximum duties). That is, the dot count value that unit area becomes 512 (16 rasters×16 pixels×2 colors). For this dot count value, the thinning rank graph of the color area: blue shown in FIGS. 22A–22F are used, and the graphs are referred with dot count value 512. In this case, relatively high thinning rate of the thinning is executed such that the rank 5 is applied to the cyan ink lower (FIG. 22A) and the rank 5 is applied to the magenta ink lower (FIG. 22C).

Figure 23A:
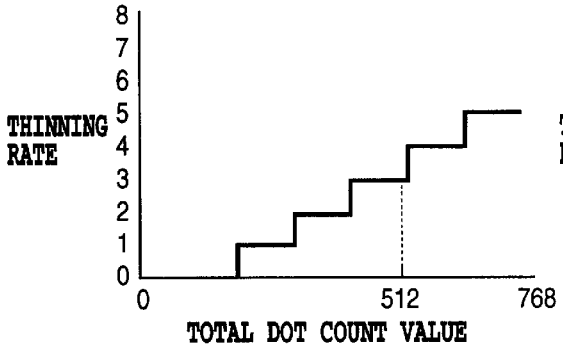
FIGS. 23A–23F are views showing examples of thinning rank graphs for another color according to the second embodiment.
Figure 23B:
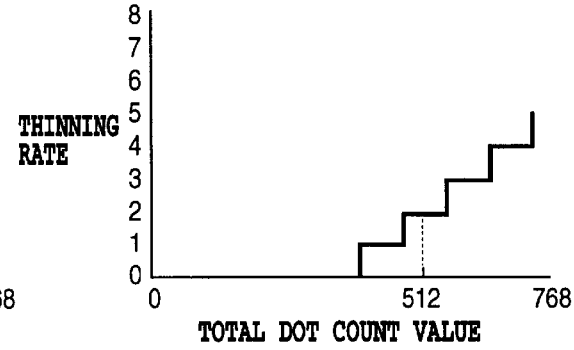
Figure 23C:
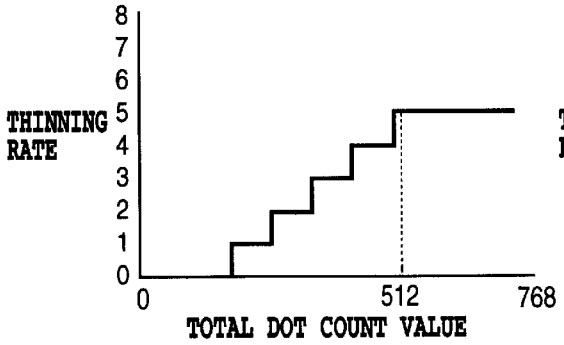
Figure 23D:
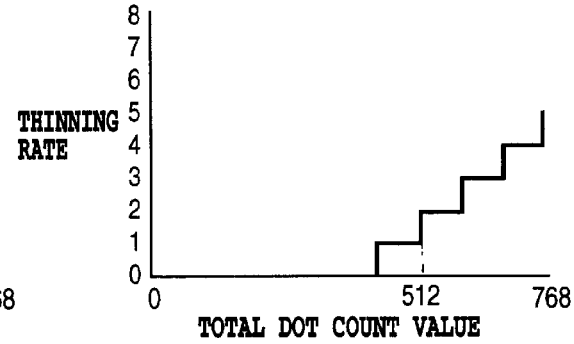
Figure 23E:
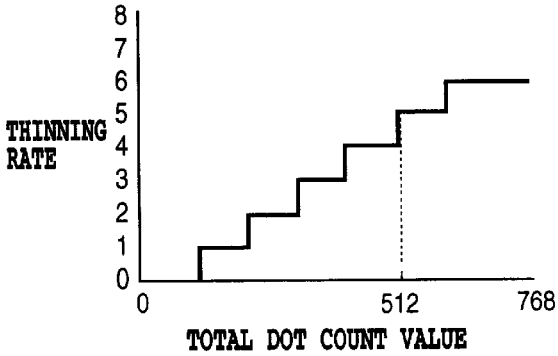
Figure 23F:
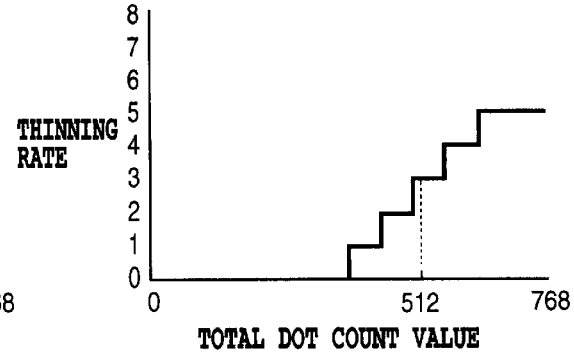
Figure 24:
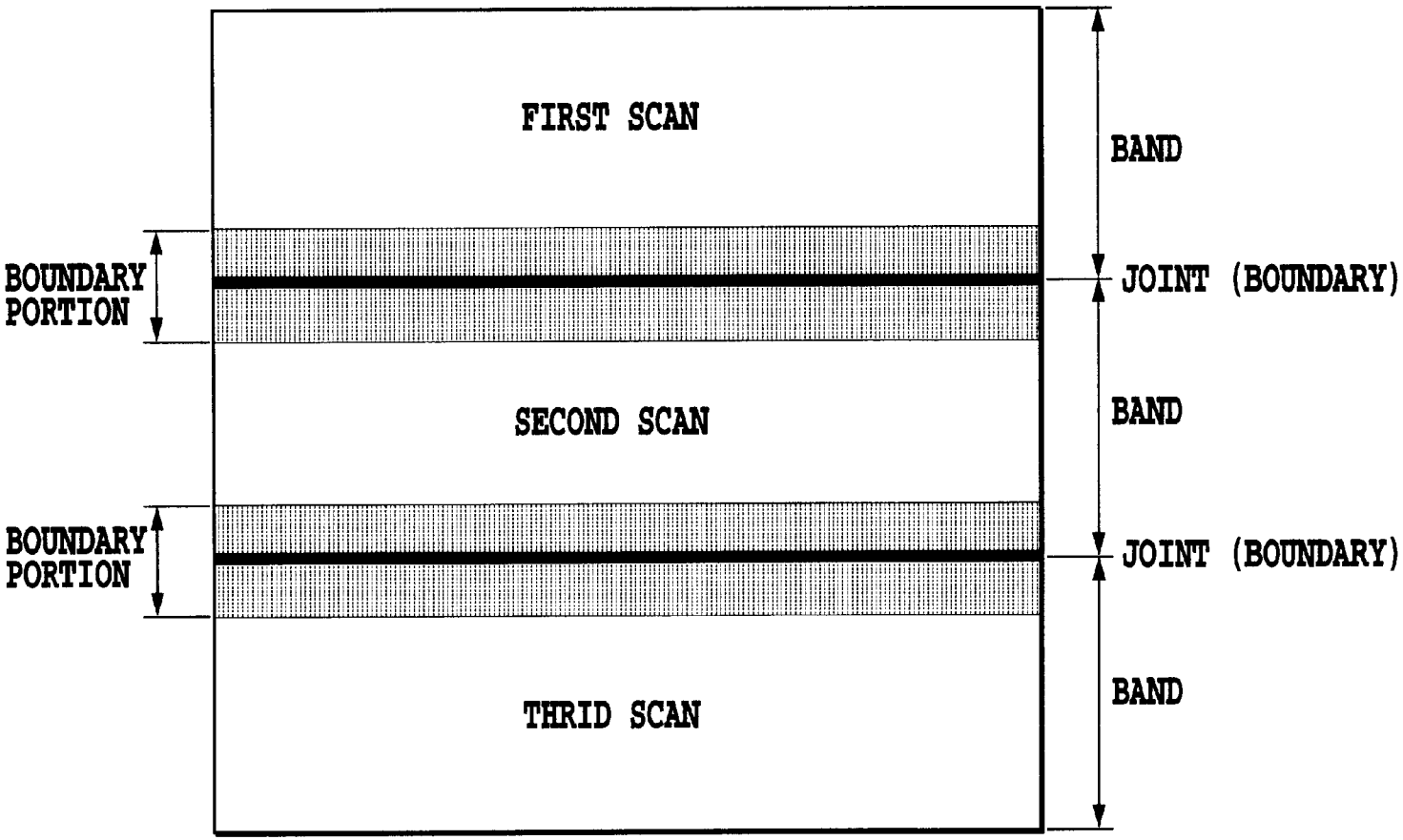
FIG. 24 is a conceptual drawing illustrating bands and a boundary therebetween according to the embodiment of the present invention.

Further, in the case of printing color changing from white through red to UC, the cyan ink starts to be used at a point where maximum saturation or maximum gradation of red starts to turn to UC. Further, duty of each of magenta and yellow is maximum at this point. Accordingly, the dot count value is 512 as the same value of the above stated maximum point of blue and the color area is determined to be red. Therefore, the thinning graphs shown in FIGS. 23A–23F are used and thus the thinning is executed by applying the rank 3 to the cyan ink lower (FIG. 23A) and the rank 5 to the magenta lower ink (FIG. 23C). In this manner, the relatively low thinning rate is used for cyan ink, thereby the dots of cyan, which have not been densely arranged yet because the data of cyan has just started to be input, are not so much thinned, so that cyan dot is prevented from missing noticeably.

In the first and second examples, the area of 16 pixels (main-scanning direction)×16 rasters (sub-scanning direction) is used as the dot count area, but the preset invention is not specifically limited to this size. The size of the unit area is desirably determined on the basis of various factors such as the extent of joint streaks, loads on data processing, and output resolution.

Furthermore, in the first and second examples, dots are counted in an area covering a joint between bands, for example, as shown in FIG. 8A, but the present invention is not limited to this method. Only the lower end of the first scanned area may be set as the dot count area, or the dot count value may be calculated for the upper end of the subsequently scanned area with respect to the joint and then used for processing.

The area on which the SMS thinning process is executed is not limited to the lower end of the first scanned area. Of course, the SMS thinning process may be executed on the upper end of the second scanned area or both the lower end of the first scanned area and the upper end of the second scanned area, that is, the area covering the joint between the bands.

As such a dot count area or an SMS thinning area, an optimal part can be desirably designated as required depending on a combination of the print medium and inks used. Thus, either or both of the dot count area are desirably changed as required depending on the print medium used.

Further, two patterns of the setting of the color areas are shown in the above variations, but the present invention is not limited to these patterns.

Furthermore, the above examples have essentially been described in conjunction with the one-pass printing. This is because the most noticeable joint streaks may occur during the one-pass printing. However, joint streaks may also occur during the multipass printing in spite of a difference in the extent of joint streaks between these two types of printing. Thus, it is effective to provide thinning rank graphs corresponding to the number of passes for the multipass printing and executing the thinning process for the multipass printing using these thinning rank graphs.

Since the joint streaks essentially result from the bleeding of the print ink on the print medium, the print ink bleeds more significantly in, for example, a hot and humid environment, resulting in more conspicuous joints. Thus, it is effective to provide a plurality of thinning rank graphs and a plurality of threshold values for changing the thinning area so as to selectively use suitable graphs and threshold values for the external environment used.

In the arrangements for the above variations, the cyan, magenta, yellow, and black print inks are used, but the present invention is also applicable to a system using what is called photo ink, which is obtained by diluting what is called regular ink.

Furthermore, in the above variations, binary data for Y, M, and C has been illustrated as data for the amount of ink ejected, but the present invention is not limited to this data. Multivalued data for R, B, and G may be used as long as it corresponds to the amount of ink ejected. In this case, the amount of ink may be reduced by multiplying the multivalued data by a reduction coefficient instead of executing the thinning.

Other Example

The present invention achieves distinct effect when applied to a recording head or a recording apparatus which has means for generating thermal energy such as electrothermal transducers or laser light, and which causes changes in ink by the thermal energy so as to eject ink. This is because such a system can achieve a high density and high resolution recording.

A typical structure and operational principle thereof is disclosed in U.S. Pat. Nos. 4,723,129 and 4,740,796, and it is preferable to use this basic principle to implement such a system. Although this system can be applied either to on-demand type or continuous type ink jet recording systems, it is particularly suitable for the on-demand type apparatus. This is because the on-demand type apparatus has electrothermal transducers, each disposed on a sheet or liquid passage that retains liquid (ink), and operates as follows: first, one or more drive signals are applied to the electrothermal transducers to cause thermal energy corresponding to recording information; second, the thermal energy induces sudden temperature rise that exceeds the nucleate boiling so as to cause the film boiling on heating portions of the recording head; and third, bubbles are grown in the liquid (ink) corresponding to the drive signals. By using the growth and collapse of the bubbles, the ink is expelled from at least one of the ink ejection orifices of the head to form one or more ink drops. The drive signal in the form of a pulse is preferable because the growth and collapse of the bubbles can be achieved instantaneously and suitably by this form of drive signal. As a drive signal in the form of a pulse, those described in U.S. Pat. Nos. 4,463,359 and 4,345,262 are preferable. In addition, it is preferable that the rate of temperature rise of the heating portions described in U.S. Pat. No. 4,313,124 be adopted to achieve better recording.

U.S. Pat. Nos. 4,558,333 and 4,459,600 disclose the following structure of a recording head, which is incorporated to the present invention: this structure includes heating portions disposed on bent portions in addition to a combination of the ejection orifices, liquid passages and the electrothermal transducers disclosed in the above patents. Moreover, the present invention can be applied to structures disclosed in Japanese Patent Application Laid Open Nos. 59-123670 (1984) and 59-138461 (1984) in order to achieve similar effects. The former discloses a structure in which a slit common to all the electrothermal transducers is used as ejection orifices of the electrothermal transducers, and the latter discloses a structure in which openings for absorbing pressure waves caused by thermal energy are formed corresponding to the ejection orifices. Thus, irrespective of the type of the recording head, the present invention can achieve recording positively and effectively.

The present invention can be also applied to a so-called full-line type recording head whose length equals the maximum length across a recording medium. Such a recording head may consists of a plurality of recording heads combined together, or one integrally arranged recording head.

In addition, the present invention can be applied to various serial type recording heads: a recording head fixed to the main assembly of a recording apparatus; a conveniently replaceable chip type recording head which, when loaded on the main assembly of a recording apparatus, is electrically connected to the main assembly, and is supplied with ink therefrom; and a cartridge type recording head integrally including an ink reservoir.

It is further preferable to add a recovery system, or a preliminary auxiliary system for a recording head as a constituent of the recording apparatus because they serve to make the effect of the present invention more reliable. Examples of the recovery system are a capping means and a cleaning means for the recording head, and a pressure or suction means for the recording head. Examples of the preliminary auxiliary system are a preliminary heating means utilizing electrothermal transducers or a combination of other heater elements and the electrothermal transducers, and a means for carrying out preliminary ejection of ink independently of the ejection for recording. These systems are effective for reliable recording.

The number and type of recording heads to be mounted on a recording apparatus can be also changed. For example, only one recording head corresponding to a single color ink, or a plurality of recording heads corresponding to a plurality of inks different in color or concentration can be used. In other words, the present invention can be effectively applied to an apparatus having at least one of the monochromatic, multi-color and full-color modes. Here, the monochromatic mode performs recording by using only one major color such as black. The multi-color mode carries out recording by using different color inks, and the full-color mode performs recording by color mixing.

Furthermore, although the above-described embodiments use liquid ink, inks that are liquid when the recording signal is applied can be used: for example, inks can be employed that solidify at a temperature lower than the room temperature and are softened or liquefied in the room temperature. This is because in the ink jet system, the ink is generally temperature adjusted in a range of 30° C.–70° C. so that the viscosity of the ink is maintained at such a value that the ink can be ejected reliably.

In addition, the present invention can be applied to such apparatus where the ink is liquefied just before the ejection by the thermal energy as follows so that the ink is expelled from the orifices in the liquid state, and then begins to solidify on hitting the recording medium, thereby preventing the ink evaporation: the ink is transformed from solid to liquid state by positively utilizing the thermal energy which would otherwise cause the temperature rise; or the ink, which is dry when left in air, is liquefied in response to the thermal energy of the recording signal. In such cases, the ink may be retained in recesses or through holes formed in a porous sheet as liquid or solid substances so that the ink faces the electrothermal transducers as described in Japanese Patent Application Laid Open Nos. 54-56847 (1979) or 60-71260 (1985). The present invention is most effective when it uses the film boiling phenomenon to expel the ink.

Furthermore, the ink jet recording apparatus of the present invention can be employed not only as an image output terminal of an information processing device such as a computer, but also as an output device of a copying machine including a reader, and as an output device of a facsimile apparatus having a transmission and receiving function.

As described above, according to the embodiments of the present invention, the printing method information, which is added to the printing data, enables the identification of, for example, a type of the print medium and the number of times of scanning operations required to complete printing a band, and then, it can be determined on the basis of the result of the identification whether or not to reduce the amount of ink landing on the vicinity of a joint. When it is determined that the amount of ink landing on the vicinity of the joint is to be reduced, a printing operation is executed according to the printing method indicated by the printing method information, and a process is executed so that the amount of ink ejected during the scanning operation is reduced at a reduction rate corresponding to the amount of ink landing on a predetermined area in the vicinity of the joint on the basis of the printing data. On the other hand, when it is determined that the amount of ink is not to be reduced, the printing operation is executed according to the printing method indicated by the printing method information without reducing the amount of ink ejected during the scanning operation. Consequently, in the case that the amount of ink is to be reduced, a proper ink amount reduction, which agrees with the type of the printing medium and the number of times of scanning operations indicated by the printing method information, can be executed. On the other hand, when it is determined that the amount of ink is not to be reduced, the restraint of the occurrence of the streak can be achieved by performing the printing operation according to the printing method with no process for reducing the amount of ink. Furthermore, an unwanted process for reducing the amount of ink can be avoided.

As a result, an printed image in which the joint streak is reduced can be obtained what ever the type of the printing medium and the number of times of scanning operation is, and the printing speed can be prevented from decreasing when the correction for joint streak is not required.

The present invention has been described in detail with respect to preferred embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. An ink jet printing apparatus using a printing head and relatively scanning the printing head to a printing medium to perform printing by ejecting a plurality of colors of ink from the printing head, said apparatus comprising:

determining means for determining whether to reduce an amount of ink to be ejected to a vicinity of a joint in a band on the printing medium, the band being defined by the joint and defined as an area printed by scanning the printing head, based on printing method information added to printing data; and printing control means for when said determining means determine to reduce the amount of ink, correcting the printing data so that the amount of ink ejected to a predetermined area in the vicinity of the joint during the scanning is decreased at a decreasing rate corresponding to an amount of ink to be ejected based on the printing data, and controlling said printing apparatus to perform printing according to a printing method designated by the printing method information, based on the corrected printing data, and when said determining means determine not to reduce the amount of ink, controlling said printing apparatus to perform printing according to a printing method designated by the printing method information, based on the printing data without executing correcting of the printing data for decreasing an amount of ink ejected during the scanning.

2. An ink jet printing apparatus as claimed in claim 1, wherein the printing method information comprises at least one of a type of the printing medium and the number of times of scanning for completing printing of the band.

3. An ink jet printing apparatus as claimed in claim 1, wherein said printing control means comprises count means for counting the number of printing data of binary form in a count area near to the joint to obtain the amount of ink to be ejected based on the printing data, a thinning rate determining means for determining a thinning rate for the binary printing data as the decreasing rate, and a decreasing means for thinning the binary printing data of the predetermined area based on the thinning rate to correct the printing data.

4. An ink jet printing apparatus as claimed in claim 3, wherein the printing head ejects a plurality of colors of ink, and said thinning rate determining means comprises color area determining means for determining hue or both hue and saturation of the predetermined area based on information on the amount of ink obtained by said count means, so as to determine the thinning rate based on the determined hue or both hue and saturation of the predetermined area and the number of printing data corresponding to the amount of ink to be ejected to the count area.

5. An ink jet printing apparatus as claimed in claim 4, wherein the printing head ejecting the plurality of colors of ink consists of a different printing head for each color of ink and the different printing heads are arranged in a direction along a scanning direction of said different printing heads.

6. An ink jet printing apparatus as claimed in claim 4, wherein said thinning rate determining means determines the thinning rate based on hue or both hue and saturation determined by said color area determining means and a sum of the amount of each color of ink to be ejected to the count area.

7. An ink jet printing apparatus as claimed in claim 4, wherein said count means cause the obtained number of printing data to be weighted for each color of ink.

8. An ink jet printing apparatus as claimed in claim 4, wherein said thinning rate determining means determine the thinning rate for each divided area, which is obtained by dividing the predetermined area.

9. An ink jet printing apparatus as claimed in claim 8, wherein the divided area is obtained by dividing the predetermined area in a different direction from the scanning direction.

10. An ink jet printing apparatus as claimed in claim 4, wherein said thinning rate determining means determine one of the thinning rates set for the respective hue or the respective combination of hue and saturation, determined by said color area determining means.

11. An ink jet printing apparatus as claimed in claim 10, wherein said thinning rate determining means determine one of the thinning rates set independently for each color of ink used for printing.

12. An ink jet printing apparatus as claimed in claim 4, wherein said thinning rate determining means determine the thinning rate as a thinning rank of a predetermined discrete value.

13. An ink jet printing apparatus as claimed in claim 8, wherein said decreasing means perform a thinning process based on the thinning rate determined for each divided area.

14. An ink jet printing apparatus as claimed in claim 4, wherein said decreasing means perform a thinning process independently for each color of ink.

15. An ink jet printing method using a printing head and relatively scanning the printing head to a printing medium to perform printing by ejecting a plurality of colors of ink from the printing head, said method comprising the steps of:

determining whether to reduce an amount of ink to be ejected to a vicinity of a joint in a band on the printing medium, the band being defined by the joint and defined as an area printed by scanning the printing head, based on printing method information added to printing data;

when it is determined in said determining step to reduce the amount of ink, correcting the printing data so that the amount of ink ejected to a predetermined area in the vicinity of the joint during the scanning is decreased at a decreasing rate corresponding to an amount of ink to be ejected based on the printing data, and controlling the printing apparatus to perform printing according to a printing method designated by the printing method information, based on the corrected printing data, and when it is determined in said determining step not to reduce the amount of ink, controlling the printing apparatus to perform printing according to a printing method designated by the printing method information, based on the printing data without executing correcting of the printing data for decreasing an amount of ink ejected during the scanning.

16. An ink jet printing method as claimed in claim 15, wherein the printing method information comprises at least one of a type of the printing medium and the number of times of scanning for completing printing of the band.

17. An ink jet printing method as claimed in claim 15, wherein said printing control step comprises a count step, of counting the number of printing data of binary form in a count area near to the joint to obtain the amount of ink to be ejected based on the printing data, a thinning rate determining step, of determining a thinning rate for the binary printing data as the decreasing rate, and a decreasing step, of thinning the binary printing data of the predetermined area based on the thinning rate to correct the printing data.

18. An ink jet printing method as claimed in claim 17, wherein the printing head ejects a plurality of colors of ink, and said thinning rate determining step comprises a color area determining step, of determining hue or both hue and saturation of the predetermined area based on information on the amount of ink obtained by said count step, so as to determine the thinning rate based on the determined hue or both hue and saturation of the predetermined area and the number of printing data corresponding to the amount of ink to be ejected to the count area.

19. An ink jet printing method as claimed in claim 18, wherein the printing head ejecting the plurality of colors of ink has a different printing head for each color of ink and the different printing heads are arranged in a direction along a scanning direction of the different printing heads.

20. An ink jet printing method as claimed in claim 18, wherein said thinning rate determining step includes determining the thinning rate based on hue or both hue and saturation determined in said color area determining step and a sum of the amount of each color of ink to be ejected to the count area.

21. An ink jet printing method as claimed in claim 18, wherein said count step includes causing the obtained number of printing data to be weighted for each color of ink.

22. An ink jet printing method as claimed in claim 18, wherein said thinning rate determining step includes determining the thinning rate for each divided area, which is obtained by dividing the predetermined area.

23. An ink jet printing method as claimed in claim 22, wherein the divided area is obtained by dividing the predetermined area in a different direction from the scanning direction.

24. An ink jet printing method as claimed in claim 18, wherein said thinning rate determining step includes determining one of the thinning rates set for the respective hue or the respective combination of hue and saturation, determined by said color area determining step.

25. An ink jet printing method as claimed in claim 24, wherein said thinning rate determining step includes determining one of the thinning rates set independently for each color of ink used for printing.

26. An ink jet printing method as claimed in claim 18, wherein said thinning rate determining step includes determining the thinning rate as a thinning rank of a predetermined discrete value.

27. An ink jet printing method as claimed in claim 22, wherein said decreasing step includes performing a thinning process based on the thinning rate determined for each divided area.

28. An ink jet printing method as claimed in claim 18, wherein said decreasing step includes performing a thinning process independently for each color of ink.

29. A data processing method used in an ink jet printing apparatus using a printing head and scanning the printing head relative to a printing medium to perform printing by ejecting a plurality of colors of ink from the printing head, said method comprising the steps of:

determining whether to reduce an amount of ink to be ejected to a vicinity of a joint in a band on the printing medium, the band being defined by the joint and defined as an area printed by scanning the printing head, based on printing method information added to printing data;

when it is determined said determining step to reduce the amount of ink, correcting the printing data so that the amount of ink ejected to a predetermined area in the vicinity of the joint during the scanning is decreased at a decreasing rate corresponding to an amount of ink to be ejected based on the printing data, and controlling the printing apparatus to perform printing according to a printing method designated by the printing method information, based on the corrected printing data; and when it is determined said determining step not to reduce the amount of ink, controlling the printing apparatus to perform printing according to a printing method designated by the printing method information, based on the printing data without executing correcting of the printing data for decreasing an amount of ink ejected during the scanning.

* * * * *

UNITED STATES PATENT AND TRADEMARK OFFICE

CERTIFICATE OF CORRECTION

PATENT NO. : 6,652,066 B2
DATED : November 25, 2003
INVENTOR(S) : Minoru Teshigawara et al.

It is certified that error appears in the above-identified patent and that said Letters Patent is hereby corrected as shown below:

Column 2,
Line 19, “become” should read -- becomes --.

Column 3,
Lines 50 and 59, “determine” should read -- determines --.

Column 7,
Line 49, “coop” should read -- cope --.

Column 13,
Line 50, “when” should read -- When --.

Column 17,
Line 25, “in different” should read -- differently --;
Line 27, “tend” should read -- tends --; and
Line 30, “cope” should read -- copes --.

Column 18,
Line 10, “corresponding” should read -- corresponding to --.

Column 20,
Line 5, “become” should read -- becomes --.

Column 21,
Line 1, “made” should be deleted; and
Line 12, “representing not” should read -- not representing --.

Column 22,
Line 48, “as to” should be deleted.

UNITED STATES PATENT AND TRADEMARK OFFICE

CERTIFICATE OF CORRECTION

PATENT NO. : 6,652,066 B2
DATED : November 25, 2003
INVENTOR(S) : Minoru Teshigawara et al.

It is certified that error appears in the above-identified patent and that said Letters Patent is hereby corrected as shown below:

Column 23,
Line 22, "area" should read -- area of --; and
Line 28, "Otherwise," should read -- otherwise, --.

Signed and Sealed this

Thirteenth Day of July, 2004

JON W. DUDAS
*Acting Director of the United States Patent and Trademark Office*